US006942313B2

(12) United States Patent
Kanda

(10) Patent No.: US 6,942,313 B2
(45) Date of Patent: Sep. 13, 2005

(54) PRINTING APPARATUS AND TEST PATTERN PRINTING METHOD

(75) Inventor: Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 10/636,646

(22) Filed: Aug. 8, 2003

(65) Prior Publication Data

US 2004/0032446 A1 Feb. 19, 2004

(30) Foreign Application Priority Data

Aug. 13, 2002 (JP) ..... 2002-235801

(51) Int. Cl.[7] ..... B41J 29/393
(52) U.S. Cl. ..... 347/19
(58) Field of Search ..... 347/19; 400/74; B41J 29/393

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 4,741,796 A | | 5/1988 | Althaus et al. | 156/272.4 |
| 5,696,542 A | | 12/1997 | Matsubara et al. | 347/12 |
| 6,142,604 A | | 11/2000 | Kanda et al. | 347/41 |
| 6,164,745 A | * | 12/2000 | Nagoshi et al. | 347/15 |
| 6,378,982 B2 | | 4/2002 | Ono et al. | 347/41 |
| 6,416,153 B1 | * | 7/2002 | Pan et al. | 347/19 |
| 6,517,192 B2 | | 2/2003 | Kaneko et al. | 347/43 |
| 6,540,327 B1 | | 4/2003 | Akiyama et al. | 347/43 |
| 6,726,302 B2 | * | 4/2004 | Yamada | 347/19 |
| 2002/0063750 A1 | | 5/2002 | Kanda et al. | 347/41 |
| 2002/0067393 A1 | | 6/2002 | Kanda et al. | 347/41 |
| 2002/0070997 A1 | | 6/2002 | Nakagawa et al. | 347/37 |
| 2002/0186273 A1 | | 12/2002 | Nakagawa et al. | 347/37 |
| 2002/0186274 A1 | | 12/2002 | Kanda | 347/41 |
| 2002/0186386 A1 | | 12/2002 | Kawanabe et al. | 358/1.8 |

FOREIGN PATENT DOCUMENTS

| | | | |
|---|---|---|---|
| EP | 1176802 A2 * | 1/2002 | H04N/1/50 |
| JP | 54-56847 | 5/1979 | |
| JP | 59-123670 | 7/1984 | |
| JP | 59-138461 | 8/1984 | |
| JP | 60-71260 | 3/1994 | |
| JP | 6-143618 | 5/1994 | |

OTHER PUBLICATIONS

No Author Listed, "Wire Printer Diagnostic Method", Feb. 1985, IBM Tech. Disc., vol. 27, Issue 9, p. 5042.*

* cited by examiner

*Primary Examiner*—Lamson Nguyen
*Assistant Examiner*—Blaise Mouttet
(74) *Attorney, Agent, or Firm*—Fitzpatrick, Cella, Harper & Scinto

(57) ABSTRACT

In a printing apparatus which prints by scanning a printhead having an array of printing elements on a printing medium in a direction crossing to a direction of the array, when a test pattern for verifying the printing characteristic of each printing element is to be printed, adjacent printing elements are driven in parallel to print a straight pattern with a predetermined length in the scanning direction. Printing of a straight pattern is executed a plurality of number of times so as to use all the printing elements for printing at least one straight pattern. In the printed test pattern, variations between the printing characteristics of printing elements that do not pose any problem in actual printing do not stand out. A printing element which degrades the image quality upon actual printing can be determined.

17 Claims, 22 Drawing Sheets

FIG. 4C
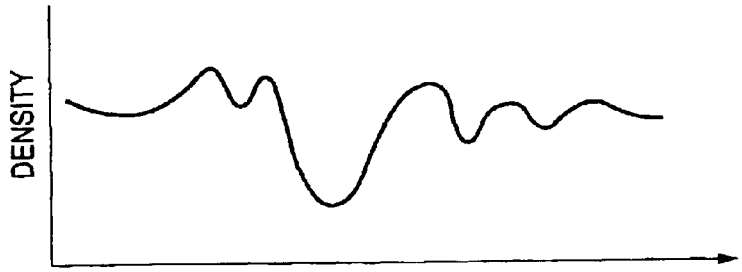
FIG. 4B
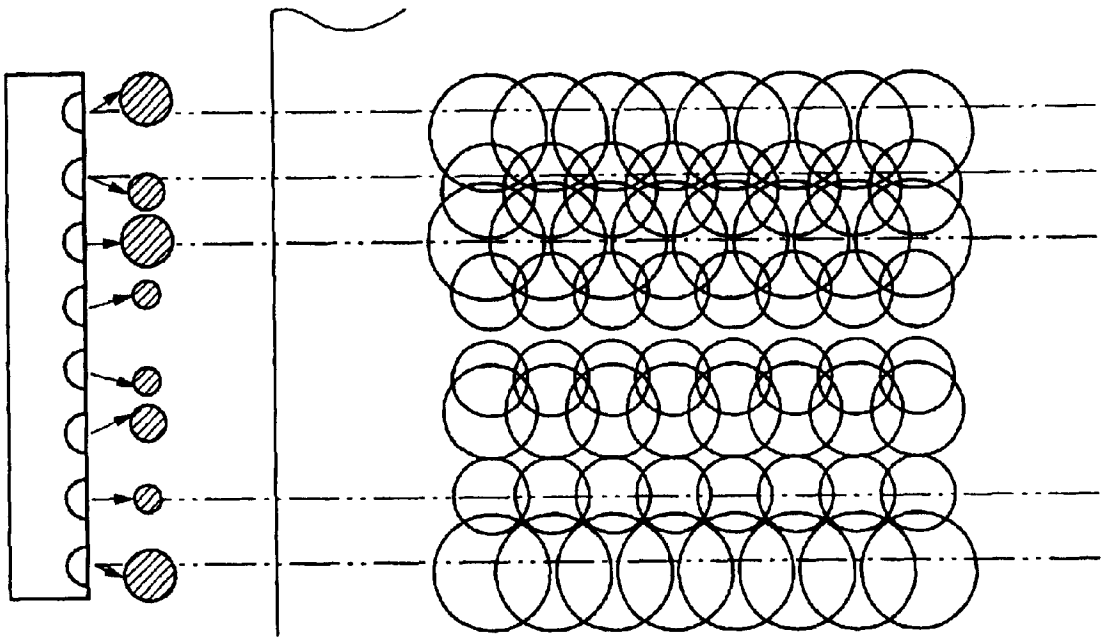
FIG. 4A

CHECKERED PATTERN PRINTING DOT

INVERSELY CHECKERED PATTERN PRINTING DOT

PRINTING APPARATUS AND TEST PATTERN PRINTING METHOD

FIELD OF THE INVENTION

The present invention relates to a printing apparatus and test pattern printing method and, more particularly, to a test pattern for verifying the printing characteristic of each printing element in a printing apparatus which prints by scanning a printhead having an array of printing elements on a printing medium in a direction crossing to a direction of the array.

BACKGROUND OF THE INVENTION

A printing apparatus having the function of a printer, copying apparatus, facsimile apparatus, or the like, or a printing apparatus used as an output device for a composite electronic device or workstation including a computer, word processor, or the like prints an image on a printing medium such as a paper sheet or thin plastic plate on the basis of image information (including character information or the like). Such printing apparatuses can be classified by the printing method into an ink-jet type, wire dot type, thermal type, laser beam type, and the like.

Of these printing apparatuses, a printing apparatus of an ink-jet type (ink-jet printing apparatus) prints by discharging ink from a printing means (printhead) onto a printing medium. The ink-jet method is superior to other printing methods because the resolution can be easily increased and the ink-jet printing apparatus achieves high speed, quietness, and low cost. On the other hand, needs for color printing have grown, and many color ink-jet printing apparatuses have been developed. As a printhead constituted by integrating and arraying a plurality of printing elements for higher printing speed, the ink-jet printing apparatus uses a printhead in which ink orifices (nozzles) serving as an ink discharge portion and a plurality of liquid channels are integrated. To cope with color printing, the ink-jet printing apparatus generally comprises a plurality of printheads.

FIG. 1 shows the arrangement of a printer part when the printhead prints on a printing sheet surface. In FIG. 1, reference numerals 101 denote ink cartridges. The ink cartridges 101 are comprised of ink tanks which respectively store four color inks, i.e., black, cyan, magenta, and yellow inks, and a printhead 102 having orifices for discharging these inks. FIG. 2 shows orifices arrayed on the printhead 102 when viewed from the z direction. Reference numerals 201 denote orifices which are arrayed in the printhead 102. The orifices are openings at the ends of nozzles, and ink is discharged from the orifices by driving discharge means arranged in the orifices.

Referring back to FIG. 1, reference numeral 103 denotes a sheet supply roller which rotates in a direction indicated by an arrow in FIG. 1 to supply a printing sheet P in the y direction while holding the printing sheet P together with an auxiliary roller 104; 105, sheet feed rollers which feed a printing sheet and also hold the printing sheet P, similar to the rollers 103 and 104; and 106, a carriage which supports the four ink cartridges and moves them along with printing. When no printing is done, or printhead recovery operation or the like is performed, the carriage 106 stands by at a home position (h) represented by the dotted line in FIG. 1.

Before the start of printing, the carriage 106 at the position (home position) in FIG. 1 moves in the x direction upon reception of a printing start instruction, and printing is executed by a plurality of orifices 201 of the printhead 102.

When printing ends up to the end of the sheet surface, the carriage returns to the home position and printing is done in the x direction again.

To print an image or the like, various elements such as color development, tone level, and uniformity are required. Especially for uniformity, variations between nozzles that occur due to the printhead manufacturing process, a change over time, or the like influence the ink discharge amount and discharge direction of each nozzle upon printing. The image quality finally degrades to density nonuniformity of a printed image.

In order to verify the discharge state of ink discharged from the printhead that degrades the image quality, a visual verification test pattern is printed. An example of the visual verification test pattern is a visual verification test pattern containing a pattern of straight lines by the number of ink orifices in which one straight line is printed by one ink orifice in the main scanning direction. This visual verification test pattern is used to verify whether the printing position on a specific straight line shifts, the color becomes faint, or the like. The result is used for determination for executing printhead recovery work.

Concrete examples of the cause of degrading the image quality to density nonuniformity of a printed image will be explained with reference to FIGS. 3A to 3C and 4A to 4C. In FIG. 3A, reference numeral 31 denotes a printhead which is constituted by eight nozzles 32; and 33, ink droplets which are discharged from the nozzles 32. Ink droplets are ideally discharged in the same direction by the same discharge amount, as shown in FIG. 3A. If ink is discharged in this manner, dots in the same size are formed on the sheet surface, as shown in FIG. 3B, and a uniform image free from any density nonuniformity as a whole can be obtained (FIG. 3C).

In practice, nozzles vary, as described above. If printing is done in the above fashion, the size and direction of ink droplets discharged from nozzles vary, as shown in FIG. 4A, and dots as shown in FIG. 4B are formed on the sheet surface. In FIG. 4B, blank portions where an area factor of 100% is not satisfied periodically exist in the main scanning direction of the head. To the contrary, dots excessively overlap each other, or blank stripes are formed, as illustrated at the center of FIG. 4B. A set of dots formed in this manner exhibits a density distribution shown in FIG. 4C in the nozzle array direction. These phenomena are generally sensed as density nonuniformity by the human eye. A stripe formed by variations in sheet supply amount may also stand out.

A method of reducing density nonuniformity is disclosed in Japanese Patent Laid-Open No. 06-143618. This method will be briefly explained with reference to FIGS. 5A to 5C and 6A to 6C. According to this method, as shown in FIGS. 5A to 5C, main scanning of the printhead 31 is performed three times in order to complete the same printing region as that of FIG. 4B (FIG. 5A). A region of four pixels which is half of each printing region is completed by two main scanning operations. In this case, the eight nozzles of the printhead are grouped into two: four upper nozzles and four lower nozzles. A dot printed by one nozzle in one main scanning is obtained by substantially halving predetermined image data in accordance with a predetermined pattern. A dot of the remaining half image data is printed in the second main scanning, completing printing of the region of four pixels. This printing method will be called a multipass printing method.

This printing method halves the influence of each nozzle on a printed image even when a printhead identical to that shown in FIG. 4A is used. A printed image as shown in FIG. 5B is almost free from black and blank stripes. As shown in FIG. 5C, density nonuniformity is greatly reduced in comparison with that in FIG. 4C. In this printing, image data is divided in accordance with a predetermined pattern so as to complement each other in the first and second main scanning operations. The pattern is generally one in which pixels are checkered or staggered one by one in the vertical and horizontal directions, as shown in FIGS. 6A to 6C. In the unit printing region (in this case, four pixels), printing is completed by the first main scanning of printing a checkered pattern and the second main scanning of printing an inversely checkered pattern.

FIGS. 6A, 6B, and 6C show a state in which a predetermined region is printed in the use of checkered and inversely checkered thinning patterns. In the first main scanning, a checkered thinning pattern is printed using four lower nozzles (FIG. 6A). In the second main scanning, the sheet is fed by four pixels (½ of the head length), and an inversely checkered thinning pattern is printed (FIG. 6B). In the third main scanning, the sheet is fed by four pixels (½ of the head length), and a checkered thinning pattern is printed (FIG. 6C). Sheet feed by four pixels and printing of checkered and inversely checkered thinning patterns are alternately performed to complete a printing region of four pixels every main scanning.

As described above, according to the multipass printing method, an image is completed by two different nozzles in the same region, and a high-quality image free from any density nonuniformity can be obtained.

In the use of the above-mentioned visual verification test pattern containing a pattern of straight lines by the number of ink orifices in which one straight line is printed by one ink orifice in the main scanning direction, even variations in discharge amount which do not degrade the quality of a printed image are verified as a discharge error particularly when the multipass printing method is adopted.

To prevent recognition of such variations as a discharge error by the visual verification test pattern, various measures are employed for increasing the printhead precision. However, further reduction of variations in characteristic that do not pose any problem in actual printing results in over-quality. Unnecessarily strict quality management in the manufacturing process increases the printhead cost.

This problem is serious particularly in an ink-jet printing apparatus which adopts the multipass printing method. The same problem occurs even in a printing apparatus using a printing method which does not execute multipass printing, other than the ink-jet method.

Demands have arisen for printing and using for visual verification a visual verification test pattern in which variations in printing characteristic that do not pose any problem in actual printing are inconspicuous, a printing element that degrades the quality of a printed image upon actual printing can be determined, and variations between the printing characteristics of printing elements can be verified at the same level as the use in actual printing.

SUMMARY OF THE INVENTION

It is an object of the present invention to provide a printing apparatus capable of printing a visual verification test pattern capable of verifying variations between the printing characteristics of printing elements at the same level as the use in actual printing.

It is another object of the present invention to provide a test pattern printing method capable of printing a visual verification test pattern capable of verifying variations between the printing characteristics of printing elements at the same level as the use in actual printing.

To achieve one object, according to the present invention, there is provided a printing apparatus which prints by scanning a printhead having an array of printing elements on a printing medium in a direction crossing to a direction of the array, comprising, test pattern printing means, when printing of a test pattern for verifying a printing characteristic of each printing element is designated, controlling driving of the printhead so as to print a test pattern including a plurality of straight patterns with a predetermined length in a scanning direction that are printed by driving adjacent printing elements in parallel, wherein all the printing elements are used for printing at least one straight pattern.

To achieve the other object, according to the present invention there is provided a test pattern printing method of verifying a printing characteristic of each printing element in a printing apparatus which prints by scanning a printhead having an array of printing elements on a printing medium in a direction crossing to a direction of the array, comprising, a straight line printing step of driving adjacent printing elements in parallel to print a straight pattern with a predetermined length in a scanning direction, and a printing repeat step of executing the straight line printing step a plurality of number of times so as to use all the printing elements for printing at least one straight pattern.

The other object is also achieved by a test pattern printing method in a printing apparatus which prints an image by using a printhead having an array of printing elements for forming dots on a printing medium and relatively scanning the printhead on the printing medium, wherein a step of printing a line in a direction different from a direction of the array that is obtained by printing with a predetermined length by a plurality of printing elements consecutive along the array including a predetermined printing element of the printhead and printing elements adjacent to the predetermined printing element while relatively scanning the printhead on the printing medium is repeated while the predetermined printing element is sequentially selected from the printing elements of the printhead, thereby performing printing.

The above objects are also achieved by a computer program which causes the printing apparatus to execute the test pattern printing method of the present invention, and a storage medium which stores the program.

More specifically, in a printing apparatus which prints by scanning a printhead having an array of printing elements on a printing medium in a direction crossing to the direction of an array of printing elements, when a test pattern for verifying the printing characteristic of each printing element is to be printed, adjacent printing elements are driven in parallel to print a straight pattern with a predetermined length in the scanning direction. Printing of a straight pattern is executed a plurality of number of times so as to use all the printing elements for printing at least one straight pattern.

In the printed test pattern, variations between the printing characteristics of printing elements that do not pose any problem in actual printing do not stand out. A printing element which degrades the image quality upon actual printing can be determined.

Variations between the printing characteristics of printing elements can be verified at the same level as the use in actual printing. An increase in printhead cost due to over-quality by unnecessarily increasing the printhead precision can be prevented.

The number of adjacent printing elements used for printing the straight pattern may range from three to five.

The test pattern printing means may control driving of the printhead so as to print the plurality of straight patterns by sequentially changing at least one of the adjacent printing elements used for printing from a printing element at one end of the printhead to a printing element at the other end of the printhead.

In this case, test pattern printing means may control driving of the printhead so as to shift the straight patterns from each other by a length not greater than the predetermined length in the scanning direction.

The test pattern printing means may control driving of the printhead so as to print the test pattern by one main scanning.

In this case, the test pattern printing means controls driving of the printhead so as to print the plurality of straight patterns in parallel.

The test pattern printing means may control driving of the printhead so as to print the test pattern by a plurality of main scanning.

The printing apparatus may comprise a plurality of printheads, and the test pattern printing means may control driving of the printheads so as to print the test pattern by each printhead.

The printing may be performed by scanning each printing region a plurality of number of times.

The printhead may include an ink-jet printhead which discharges ink to perform printing.

In this case, the printhead may include a printhead which discharges ink by using heat energy, and may comprise a thermal transducer for generating heat energy to be applied to ink.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 4A to 4C are views for explaining a printing state in which density nonuniformity occurs in the ink-jet printing apparatus;

DETAILED DESCRIPTION OF THE PREFERRED EMBODIMENTS

Preferred embodiments of the present invention will now be described in detail in accordance with the accompanying drawings.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

In the following embodiments of the present invention, an arrangement in which a heater as an ink discharge electrothermal transducer is arranged in the printhead as a discharge means for discharging ink will be exemplified. Each orifice, each nozzle, and each discharge means in the printhead are elements for performing printing, and will also be referred to as printing elements.

Figure 1:
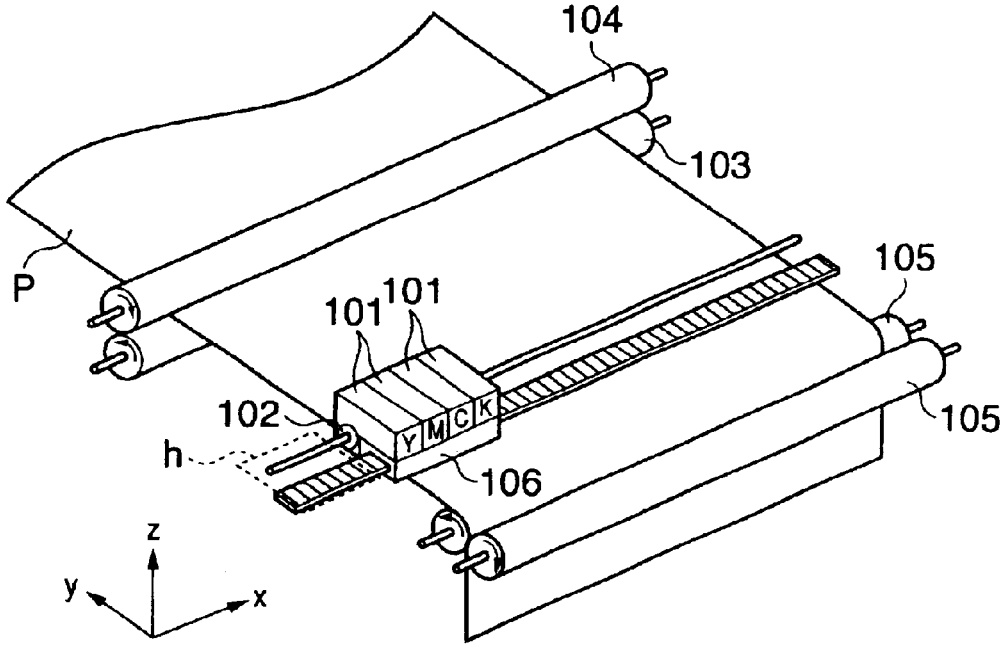
FIG. 1 is a perspective view showing the schematic arrangement of the printer part of an ink-jet printing apparatus.
Figure 2:
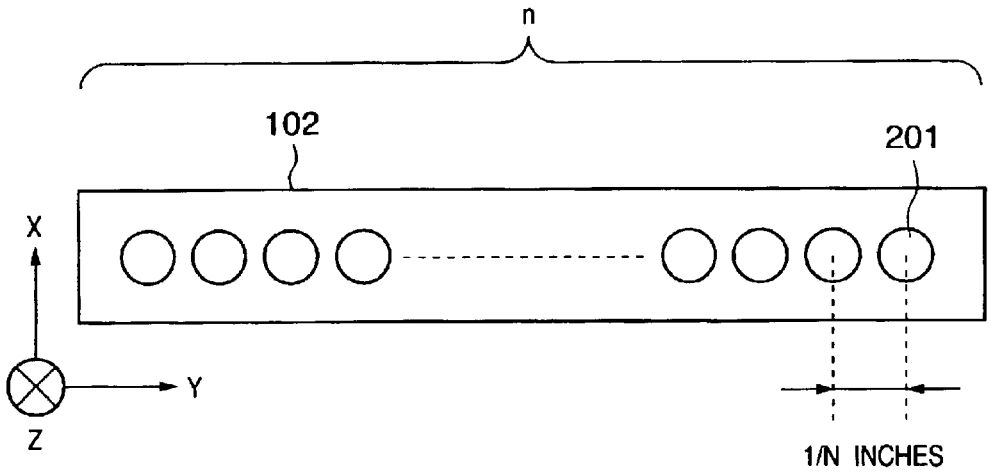
FIG. 2 is a view schematically showing the orifice array of a printhead.
Figure 3C:
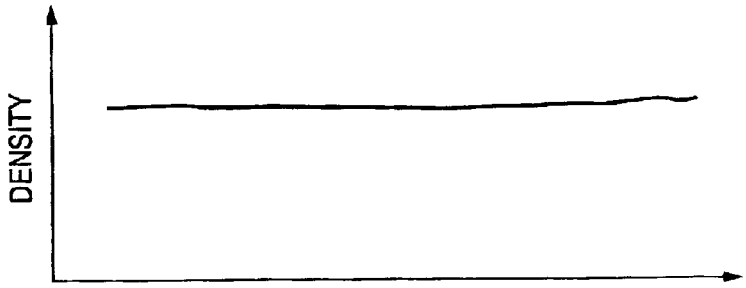
FIGS. 3A to 3C are views for explaining an ideal printing state in the ink-jet printing apparatus.
Figure 3B:
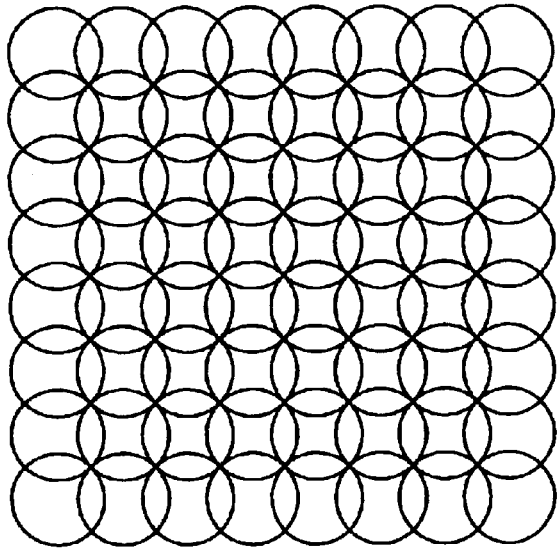
Figure 3A:
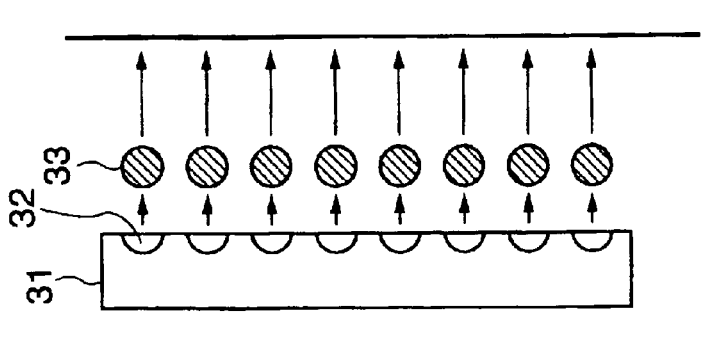
Figure 5C:
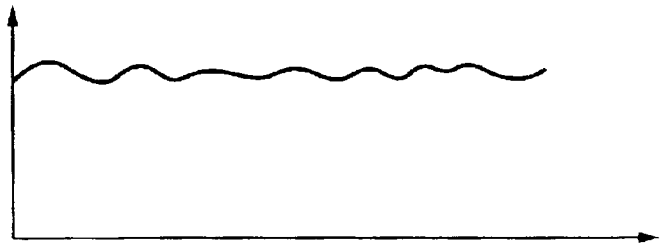
FIGS. 5A to 5C are views for explaining reduction of density nonuniformity by a multipass printing method.
Figure 5B:
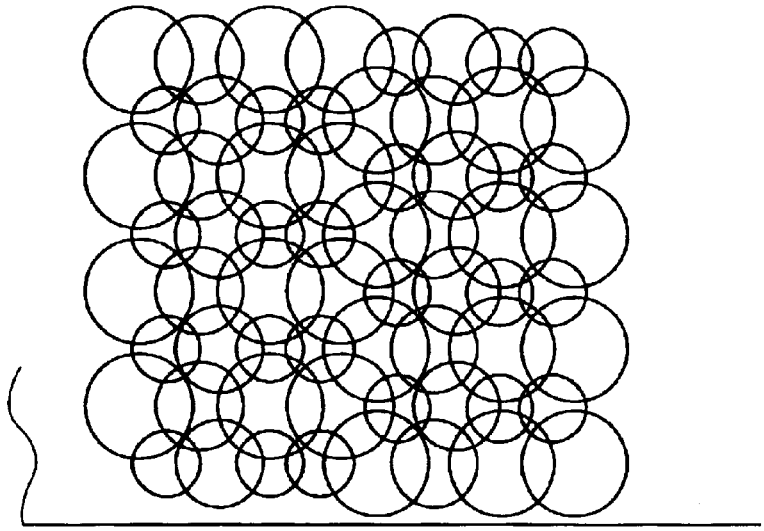
Figure 5A:
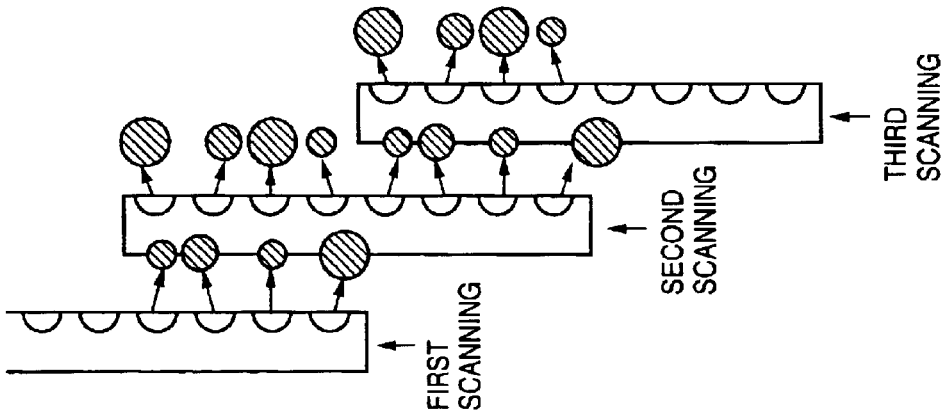
Figure 6A:
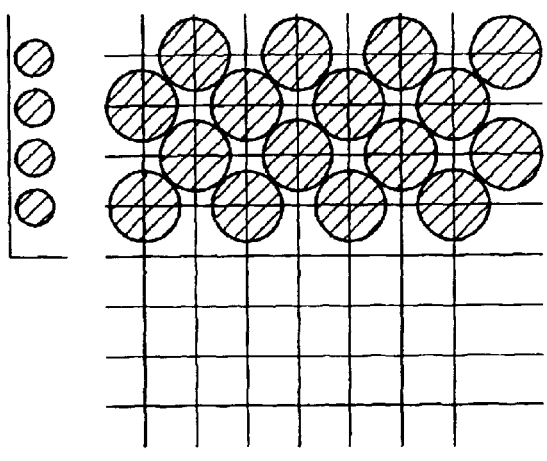
FIGS. 6A to 6C are views for explaining another example of reduction of density nonuniformity by the multipass printing method using a thinning pattern.
Figure 6B:
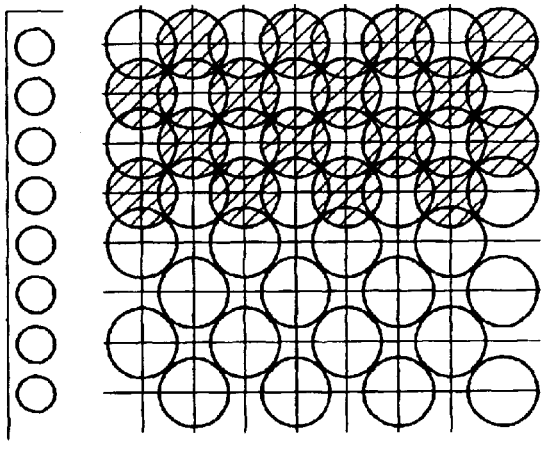
Figure 6C:
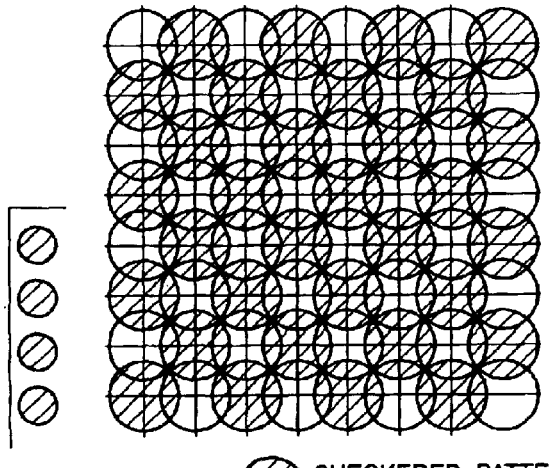
Figure 7:
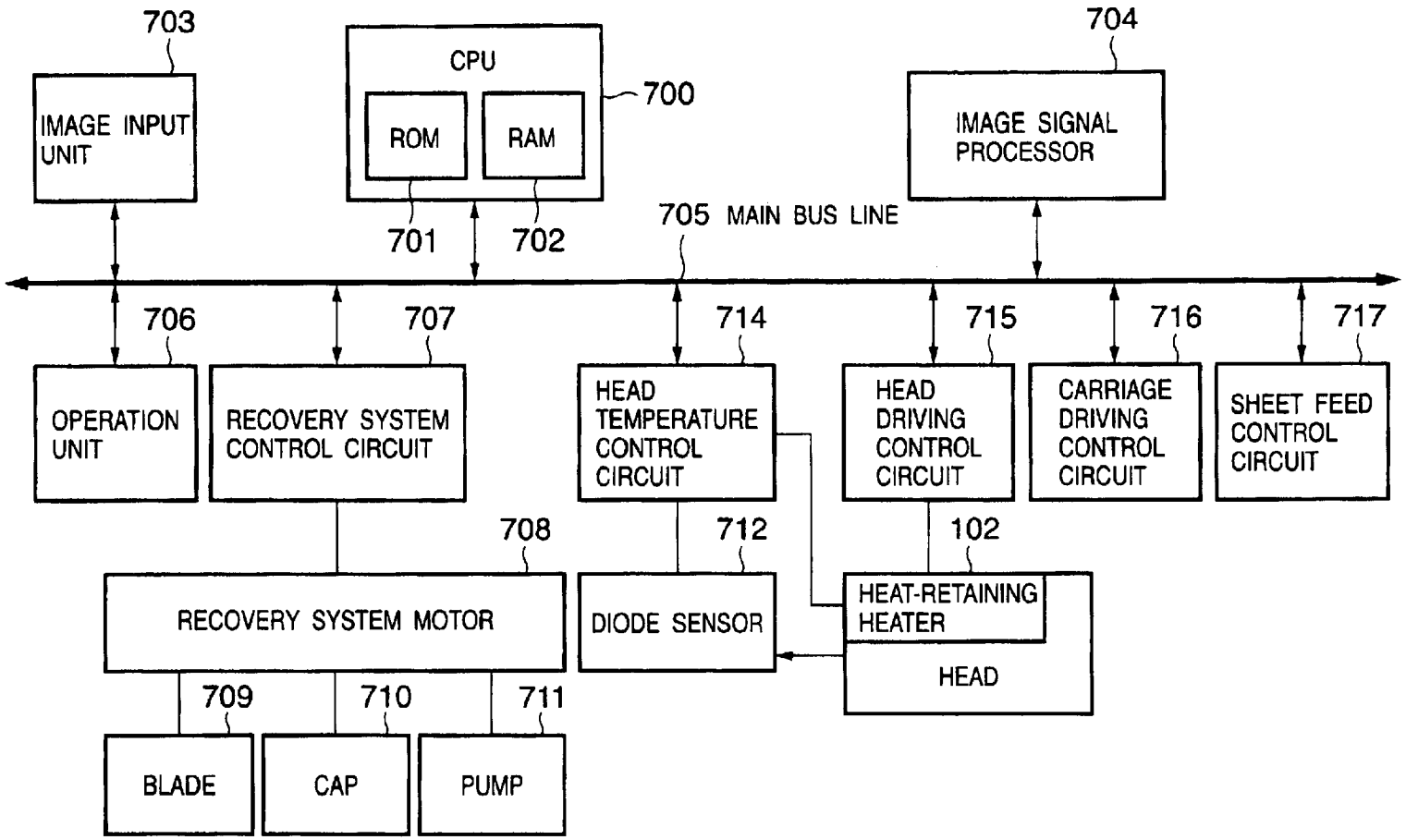
FIG. 7 is a block diagram showing the control arrangement of an ink-jet printing apparatus according to the present invention.

FIG. 7 is a block diagram showing the control arrangement of an ink-jet printing apparatus according to an embodiment of the present invention. The mechanical arrangement of the ink-jet printing apparatus according to the embodiment is the same as that shown in FIG. 1. Dots are formed on a printing medium by ink discharged upon driving of the printhead, thereby printing on the printing medium.

The arrangement shown in FIG. 7 is roughly divided into software system processing means such an image input unit 703, corresponding image signal processor 704, and CPU (Central Processing Unit) 700 which access a main bus line 705, and hardware system processing means such as an operation unit 706, recovery system control circuit 707, ink-jet head temperature control circuit 714, head driving control circuit 715, carriage driving control circuit 716 in the main scanning direction, and sheet feed control circuit 717 in the sub-scanning direction.

The CPU 700 generally comprises a ROM 701 and RAM (Random Access Memory) 702. The CPU 700 gives proper printing conditions to input information, drives a printhead 102, and performs printing. The RAM 702 stores in advance a program for executing head recovery operation. If necessary, recovery conditions such as predischarge conditions are supplied to the recovery system control circuit 707, printhead, heat-retaining heater, and the like. A recovery system motor 708 drives the printhead 102, and a cleaning blade 709, cap 710, and suction pump 711 which face the printhead 102 at an interval. The head driving control circuit 715 drives the ink discharge electrothermal transducer of the printhead 102, and causes the printhead 102 to perform general predischarge and printing ink discharge.

An heat-retaining heater is mounted on a board which supports the ink discharge electrothermal transducer of the printhead 102. The heater can adjust the ink temperature in the printhead to a desired set temperature. A diode sensor 712 is also mounted on the board, and measures the substantial ink temperature in the printhead. The diode sensor 712 may be arranged not on the board but outside or near the printhead.

Several embodiments for printing a visual verification test pattern according to the present invention by the ink-jet printing apparatus having the above arrangement will be described.

(First Embodiment)

Figure 8:
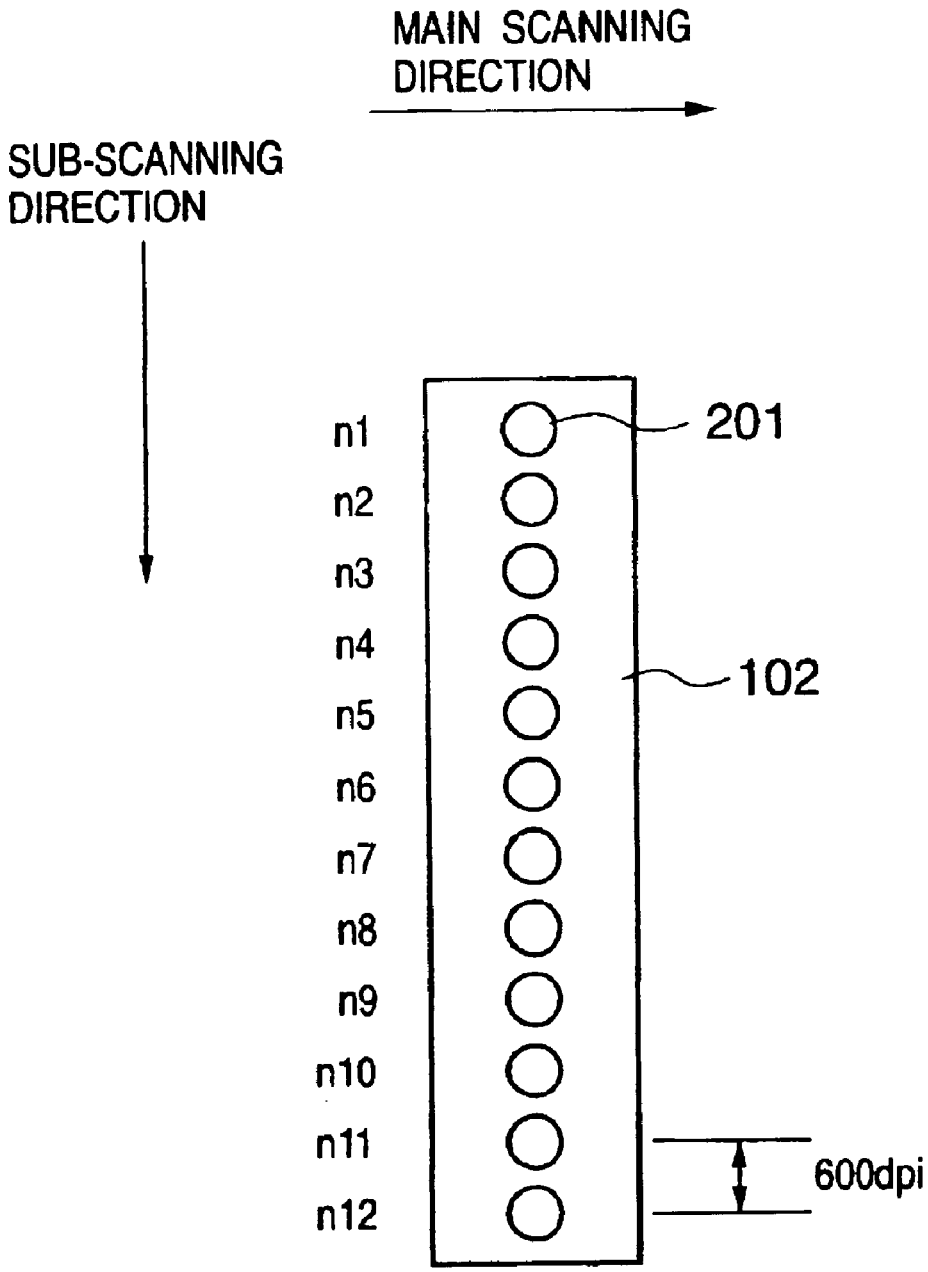
FIG. 8 is a view showing the orifice array of a printhead which can be applied to the present invention.

The first embodiment is related to a visual verification test pattern in an ink-jet printing apparatus using one printhead. FIG. 8 is a view showing a printhead 102 used in the first embodiment when viewed from the discharge surface side. The printhead 102 has 12 orifices (12 nozzles) n1 to n12 in the sub-scanning direction at a density N=600 per inch (600 dpi), and discharges color ink from each orifice by a discharge amount of about 5 pl. The main scanning printing resolution of the ink-jet printing apparatus according to the first embodiment is also 600 dpi.

Figure 10:
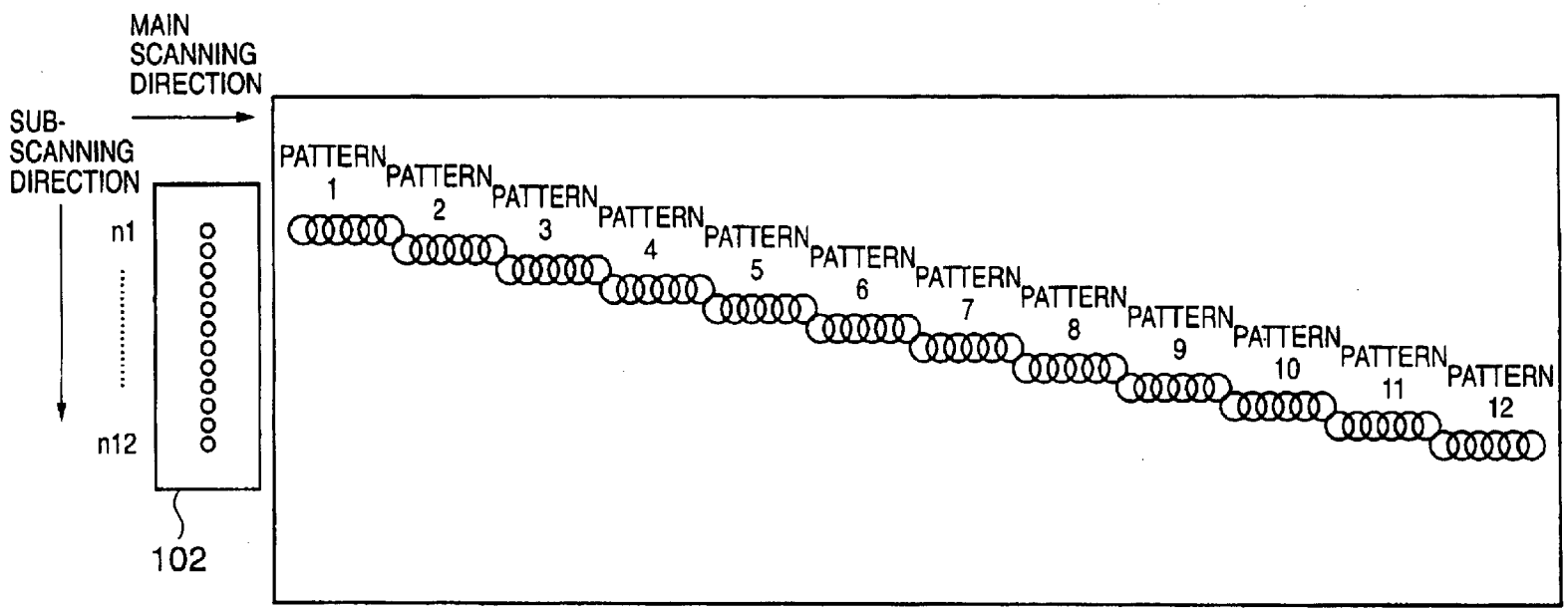
FIG. 10 PRIOR ART
FIG. 10 is a view for explaining a conventional visual verification test pattern.

A visual verification test pattern which is conventionally printed to verify the ink discharge state of the printhead will be explained with reference to FIG. 10.

Six ink droplets are discharged from the orifice n1 in the main scanning direction at an interval of 600 dpi to print a straight line of pattern 1. Six ink droplets are discharged from the orifice n2 in the main scanning direction at an interval of 600 dpi to print a straight line of pattern 2. In this manner, printing of a straight line by six ink droplets from one orifice in the main scanning direction at an interval of 600 dpi is executed by the orifices n1 to n12 in one main scanning. Printed patterns 1 to 12 are offset stepwise at 600 dpi in the sub-scanning direction.

Figure 11:
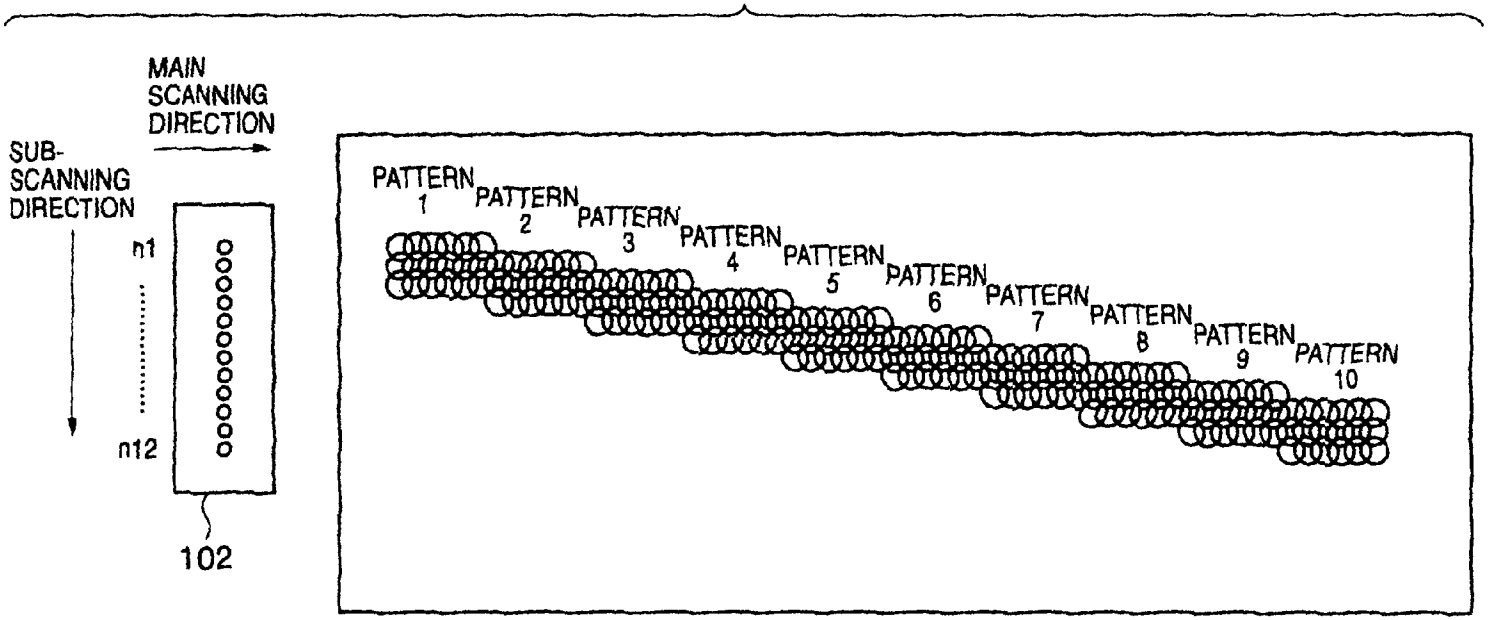
FIG. 11 is a view for explaining a visual verification test pattern according to the first embodiment of the present invention.

FIG. 11 is a view for explaining a visual verification test pattern for verifying the ink discharge state according to the first embodiment of the present invention.

In the first embodiment, six ink droplets are discharged in parallel from each of three orifices n1 to n3 in the main scanning direction at an interval of 600 dpi to print a straight line of pattern 1. Six ink droplets are discharged in parallel from each of three orifices n2 to n4 in the main scanning direction at an interval of 600 dpi to print a straight line of pattern 2. Printing of a straight line by six ink droplets discharged in parallel from each of three orifices in the main scanning direction at an interval of 600 dpi is executed by the orifices n1 to n12 in one main scanning. Printed patterns 1 to 10 are offset stepwise at 600 dpi in the sub-scanning direction.

A visual verification test pattern printing sequence according to the first embodiment will be described with reference to the flow chart of FIG. 22.

The range of orifices (nozzles) used to print pattern 1 is set (step S101). Letting S be the start orifice number and E be the end orifice number, S is set to 1 as a default value, and E is set to S+2=3.

The orifices n1 to n3 are driven in parallel, in accordance with this setting to print a straight pattern (step S102).

Whether the setting of the current end orifice number E is equal to the final nozzle number is determined (step S103). If YES in step S103, printing of straight patterns using all orifices ends, and thus printing of the visual verification test pattern ends.

If NO in step S103, the start nozzle number S is incremented by 1 (step S104), and step S101 and subsequent steps are executed again.

The test pattern shown in FIG. 11 is printed by using the printhead having an array of printing elements for forming dots on a printing medium and relatively scanning the printhead on the printing medium. The straight line of the test pattern along the main scanning direction is a line which is printed by a predetermined length by a plurality of printing elements consecutive along the array including a predetermined printing element of the printhead and printing elements adjacent to the predetermined printing element while relatively scanning the printhead on the printing medium. Line printing is repeated while a predetermined printing element is sequentially selected from a plurality of printing elements, thereby printing a test pattern.

Figure 12A:
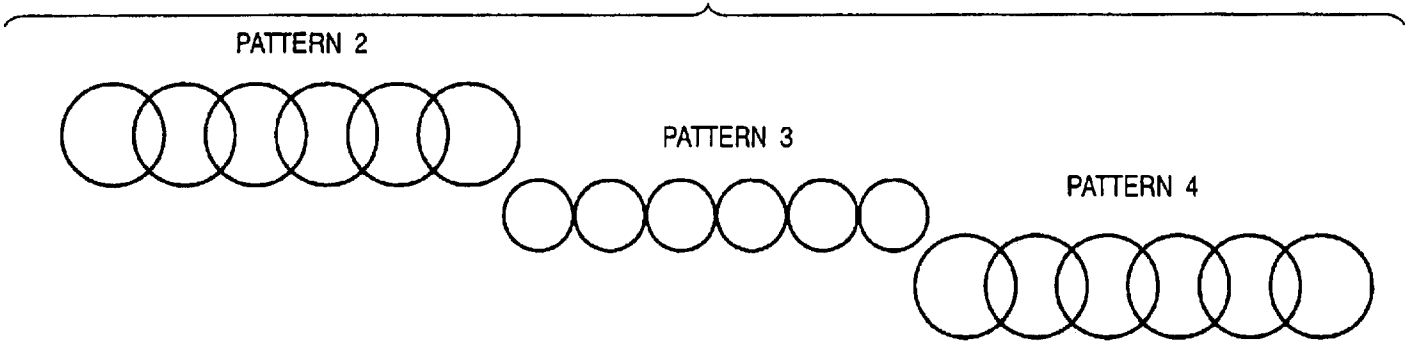
FIG. 12A PRIOR ART
FIGS. 12A and 12B are enlarged views showing a conventional visual verification test pattern and a visual verification test pattern according to the present invention when the discharge amount from a specific orifice is small.
Figure 12B:
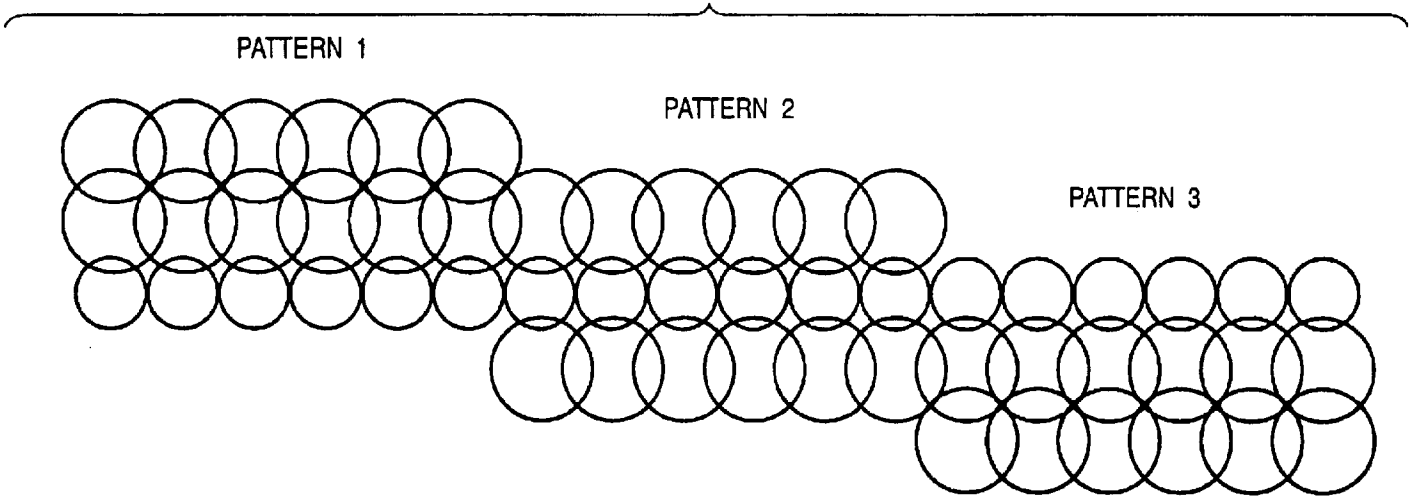

FIGS. 12A and 12B are partial enlarged views showing an example of a visual verification test pattern printed when the discharge amount from one orifice is smaller than that from another orifice. In the example shown in FIGS. 12A and 12B, FIG. 12A illustrates patterns 2 to 4 of a conventional visual verification test pattern printed similarly to the patterns of FIG. 10 when the discharge amount from the orifice n3 is about 2.5 pl. FIG. 12B illustrates patterns 1 to 3 of a visual verification test pattern of the first embodiment printed similarly to the patterns of FIG. 11.

From a comparison between FIGS. 12A and 12B, the straight line of pattern 3 printed by ink droplets discharged from n3 is readily determined to be thinner than the straight lines of patterns 2 and 4 in FIG. 12A. In FIG. 12B, each pattern is printed by ink droplets discharged in parallel from three adjacent orifices. Even if the discharge amount from one orifice is small, this is less conspicuous, and no significant density difference is determined between three straight lines. Needless to say, a significant density difference is determined when the discharge amount from the orifice n3 is excessively small or the orifice n3 does not discharge any ink.

In actual use of the above-described multipass printing method, even if the discharge amount of one orifice is half of that of another orifice, degradation of a printed image is not recognized, similar to FIG. 12B. Hence, the visual verification test pattern shown in FIG. 11 realizes visual verification consistent with an actually printed image.

As described above, according to the first embodiment, variations which do not pose any problem in actual printing do not stand out, and an orifice which is verified as a discharge error upon actual printing can be determined. Variations between the printing characteristics of orifices can be verified at the same level as the use in actual printing. An increase in printhead cost due to over-quality by unnecessarily increasing the printhead precision can be prevented.

(Modification to First Embodiment)

Figure 9:
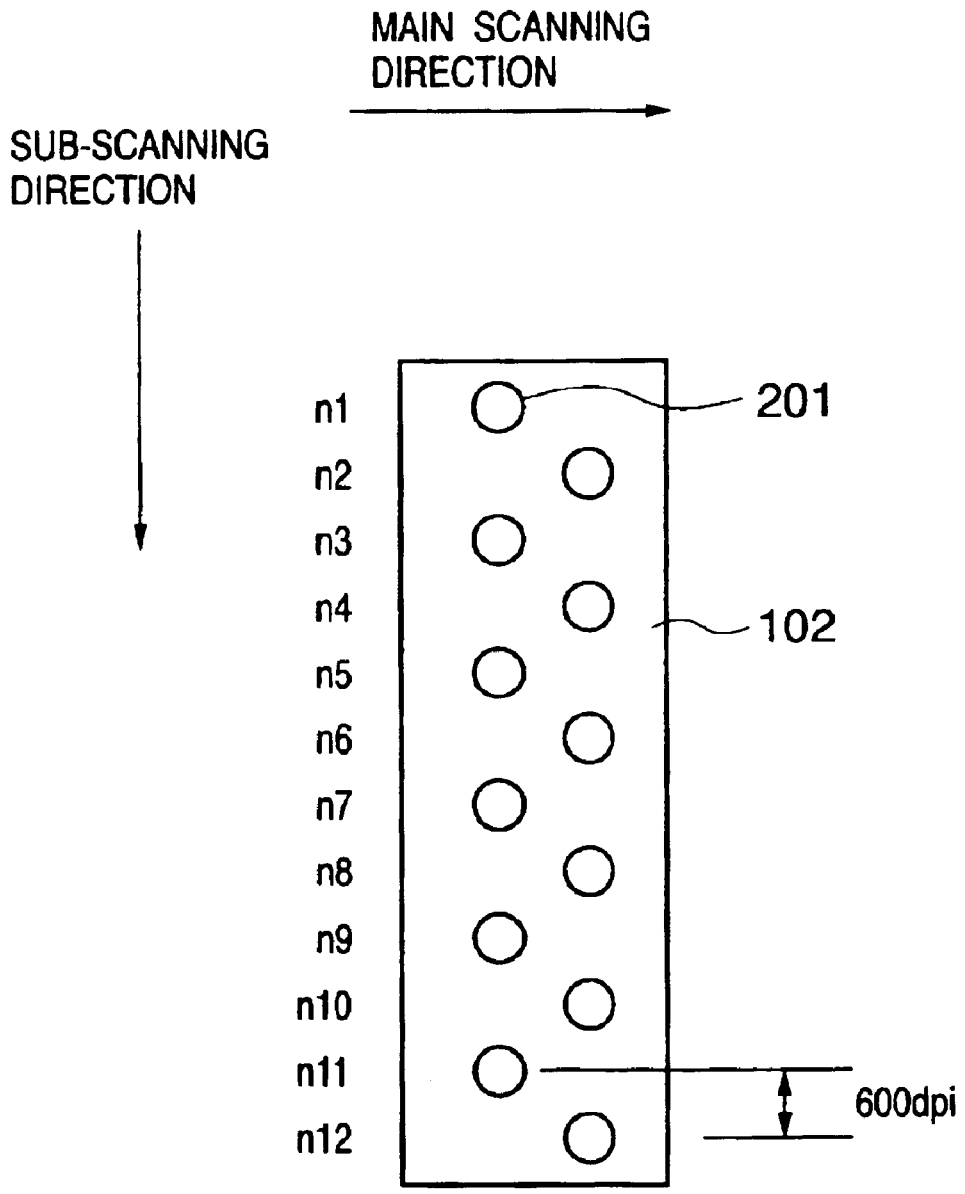
FIG. 9 is a view showing another orifice array of the printhead which can be applied to the present invention.

The printhead having the arrangement shown in FIG. 8 is employed in the first embodiment, but a printhead 102 having two checkered lines of orifices as shown in FIG. 9 may be used.

Figure 13:
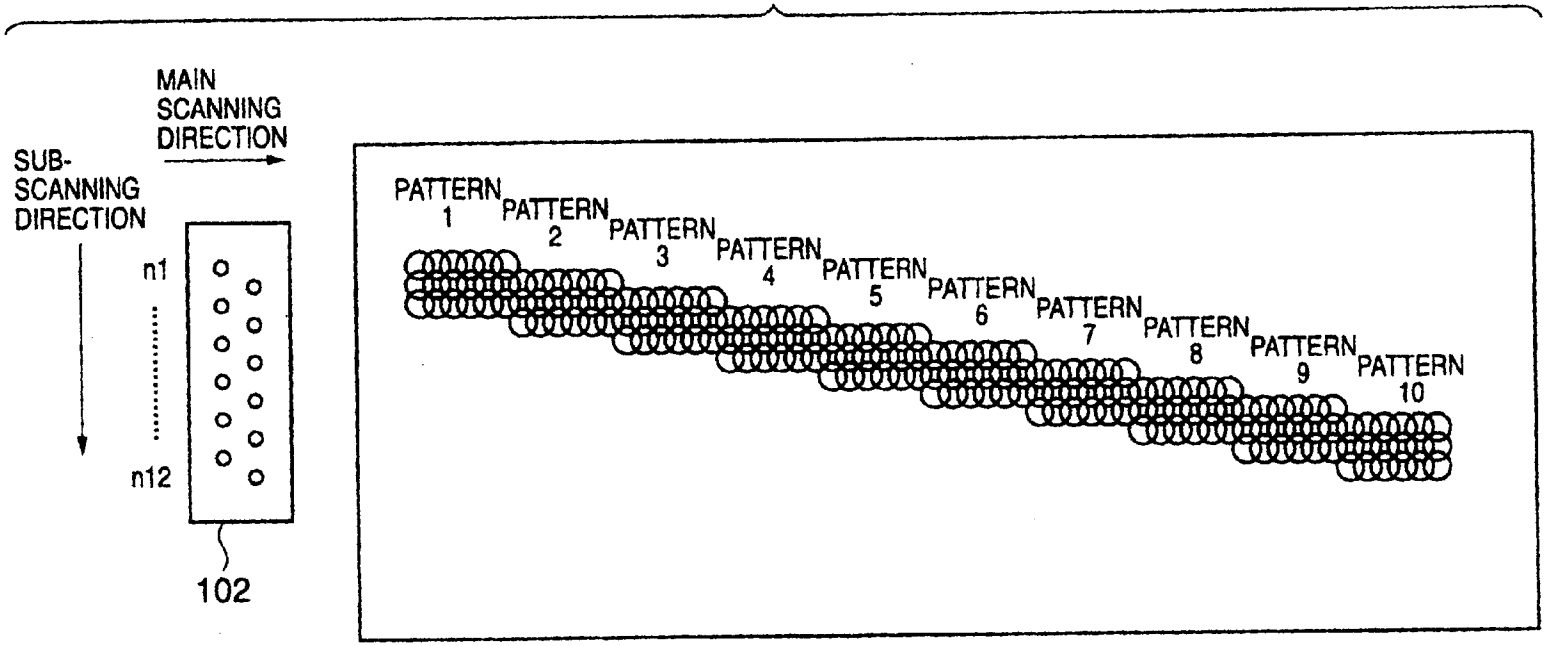
FIG. 13 is a view for explaining a visual verification test pattern having another printhead arrangement according to the first embodiment of the present invention.

FIG. 13 is a view schematically showing a visual verification test pattern printed by discharging ink droplets in parallel from three adjacent orifices. The same effects can also be obtained by this visual verification test pattern.

In the first embodiment, ink droplets are discharged in parallel from three adjacent orifices to print a visual verification test pattern. The number of orifices discharged in parallel is not limited to three, and may be larger. Three to five adjacent orifices are preferably used because of the highest consistency with an image.

Figure 14:
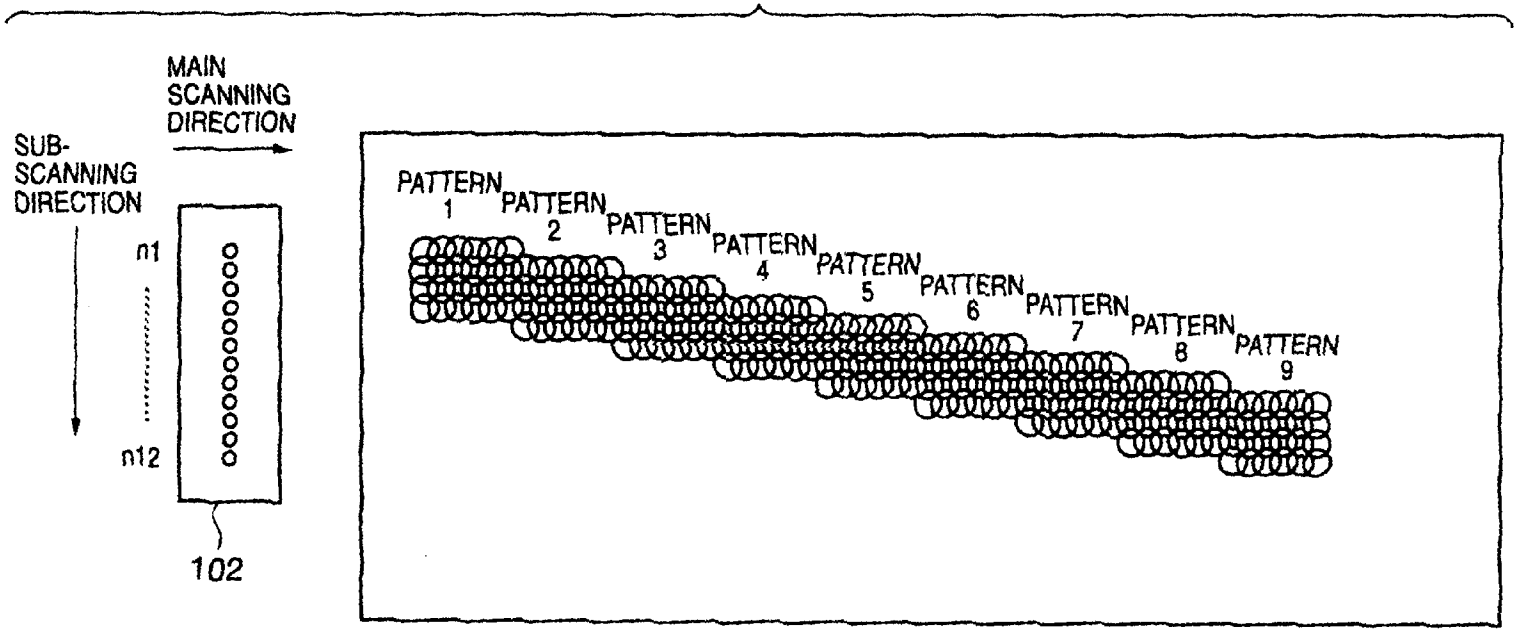
FIG. 14 is a view for explaining another visual verification test pattern according to the first embodiment of the present invention.

FIG. 14 is a view schematically showing a visual verification test pattern printed by discharging ink droplets in parallel from four adjacent orifices. The same effects can also be obtained by this visual verification test pattern.

Also, the number of orifices of the printhead is not particularly limited, and the printhead may have more than 12 orifices.

Figure 15:
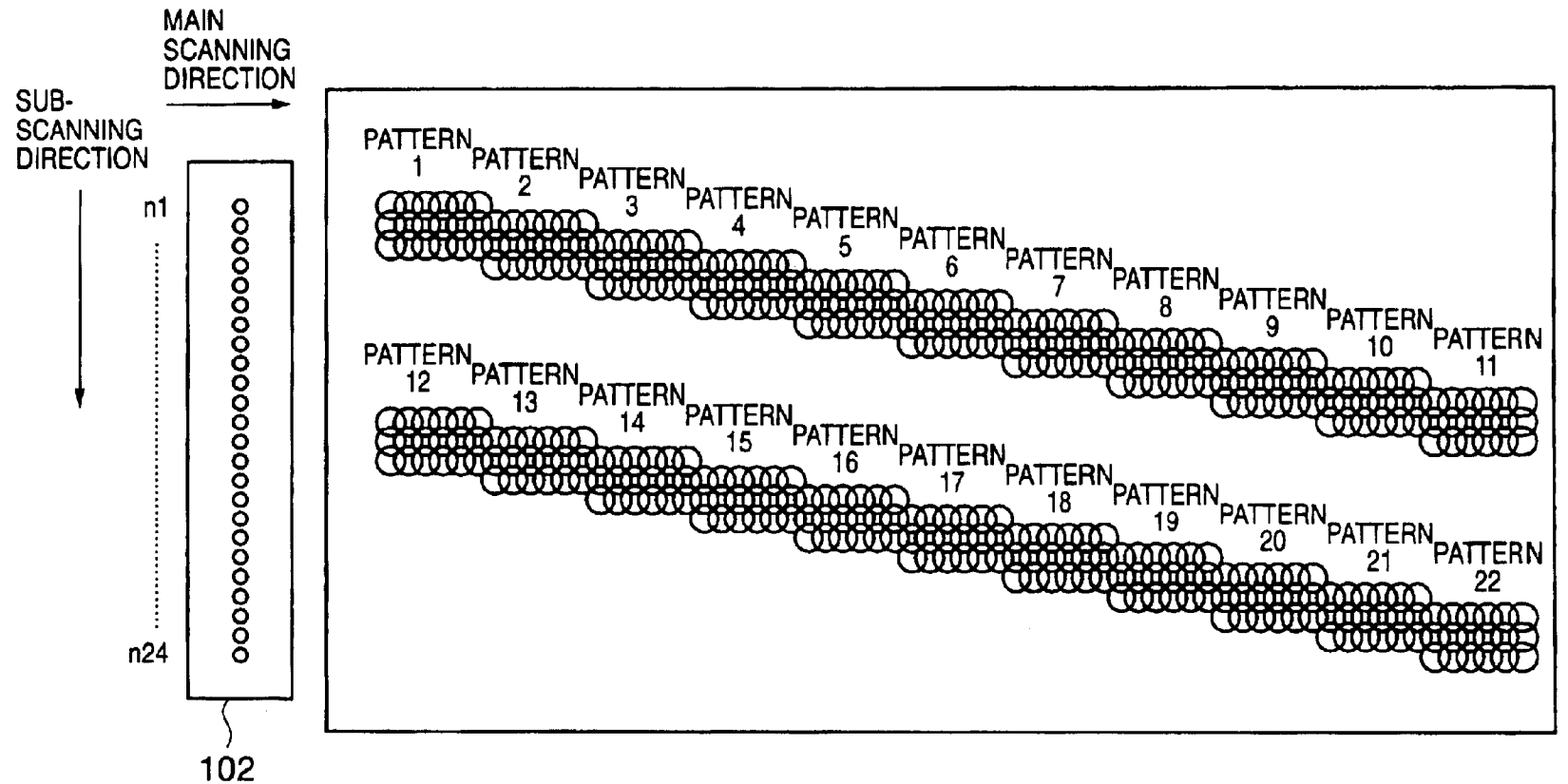
FIG. 15 is a view for explaining still another visual verification test pattern according to the first embodiment of the present invention.

FIG. 15 schematically shows a visual verification test pattern printed by a printhead having 24 orifices (24 nozzles) n1 to n24 in the sub-scanning direction at a density N=600 per inch (600 dpi).

In this case, pattern 1 printed by discharging six ink droplets in parallel from each of the three orifices n1 to n3 in the main scanning direction at an interval of 600 dpi, and pattern 12 printed by discharging six ink droplets in parallel from each of the three orifices n12 to n14 in the main scanning direction at an interval of 600 dpi are printed in parallel. Pattern 2 printed by discharging six ink droplets in parallel from each of the three orifices n2 to n4 in the main scanning direction at an interval of 600 dpi, and pattern 13 printed by discharging six ink droplets in parallel from each of the three orifices n13 to n15 in the main scanning direction at an interval of 600 dpi are printed in parallel.

Printing by discharging six ink droplets in parallel from each of three orifices in the main scanning direction at an interval of 600 dpi is executed by the orifices n1 to n13 and the orifices n12 to n24, thereby parallel-printing patterns 1 to 11 and patterns 12 to 22 in one main scanning in the sub-scanning direction. Each of two printed line patterns is offset stepwise at 600 dpi in the sub-scanning direction. Even a stepwise visual verification test pattern divided into two lines can also attain the same effects as those of the first embodiment.

In the first embodiment, patterns are stepwise patterns offset at 600 dpi in the sub-scanning direction. The offset distance between patterns in the sub-scanning direction is not limited to this value (600 dpi), and may be two or three times the distance of 600 dpi. In this case, orifices used for printing are shifted by two or three orifices, and a pattern is printed.

Figure 20:
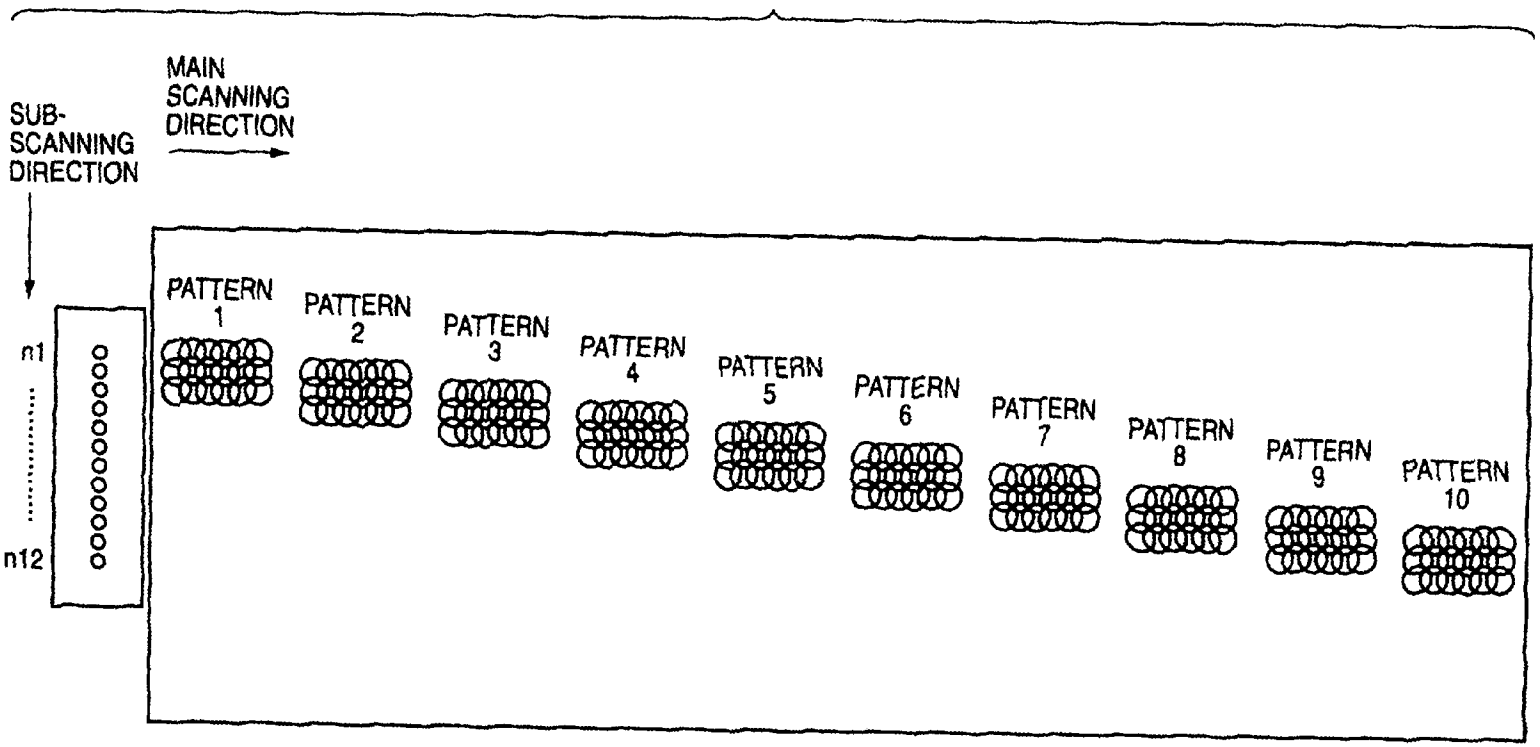
FIG. 20 is a view for explaining another visual verification test pattern according to the first embodiment of the present invention.
Figure 21:
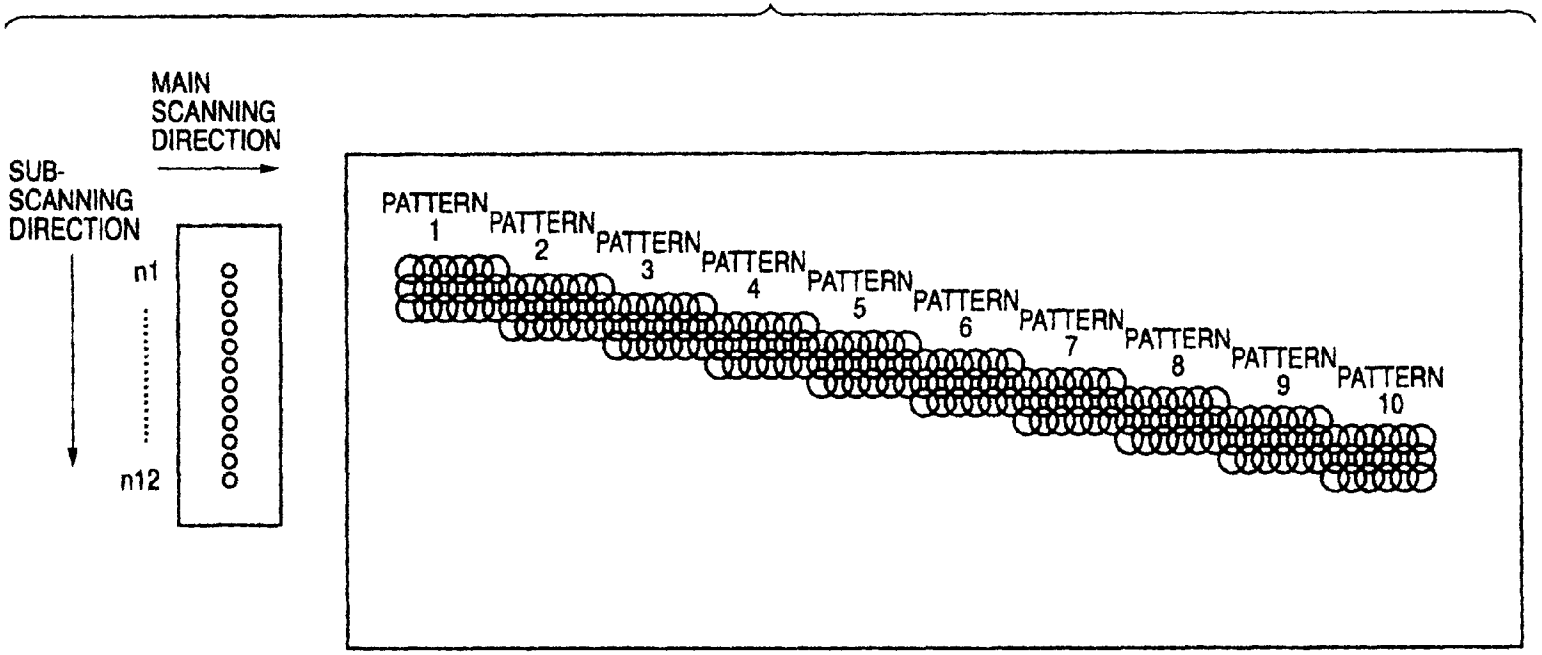
FIG. 21 is a view for explaining still another visual verification test pattern according to the first embodiment of the present invention.

Unlike the first embodiment, patterns need not always be printed successively in the main scanning direction. The same effects can also be obtained even by printing patterns at an interval in the main scanning direction, like a visual verification test pattern shown in FIG. 20. To the contrary, like a visual verification test pattern shown in FIG. 21, the interval between patterns in the main scanning direction can be decreased to print patterns so as to partially overlap each other. Also in this case, the same effects can be obtained.

(Second Embodiment)

The second embodiment according to the present invention will be described. In the following description, a description of the same parts as those in the first embodiment will be omitted, and the feature of the second embodiment will be mainly explained.

The first embodiment is related to a visual verification test pattern for an ink-jet printing apparatus which prints by using one printhead. The second embodiment is related to a visual verification test pattern for an ink-jet printing apparatus which prints by using two printheads. The ink-jet printing apparatus according to the second embodiment uses two printheads shown in FIG. 9 which are arranged side by side in the main scanning direction.

A visual verification test pattern which is conventionally printed for verifying the ink discharge states of two printheads will be explained with reference to FIG. 16.

Figure 16:
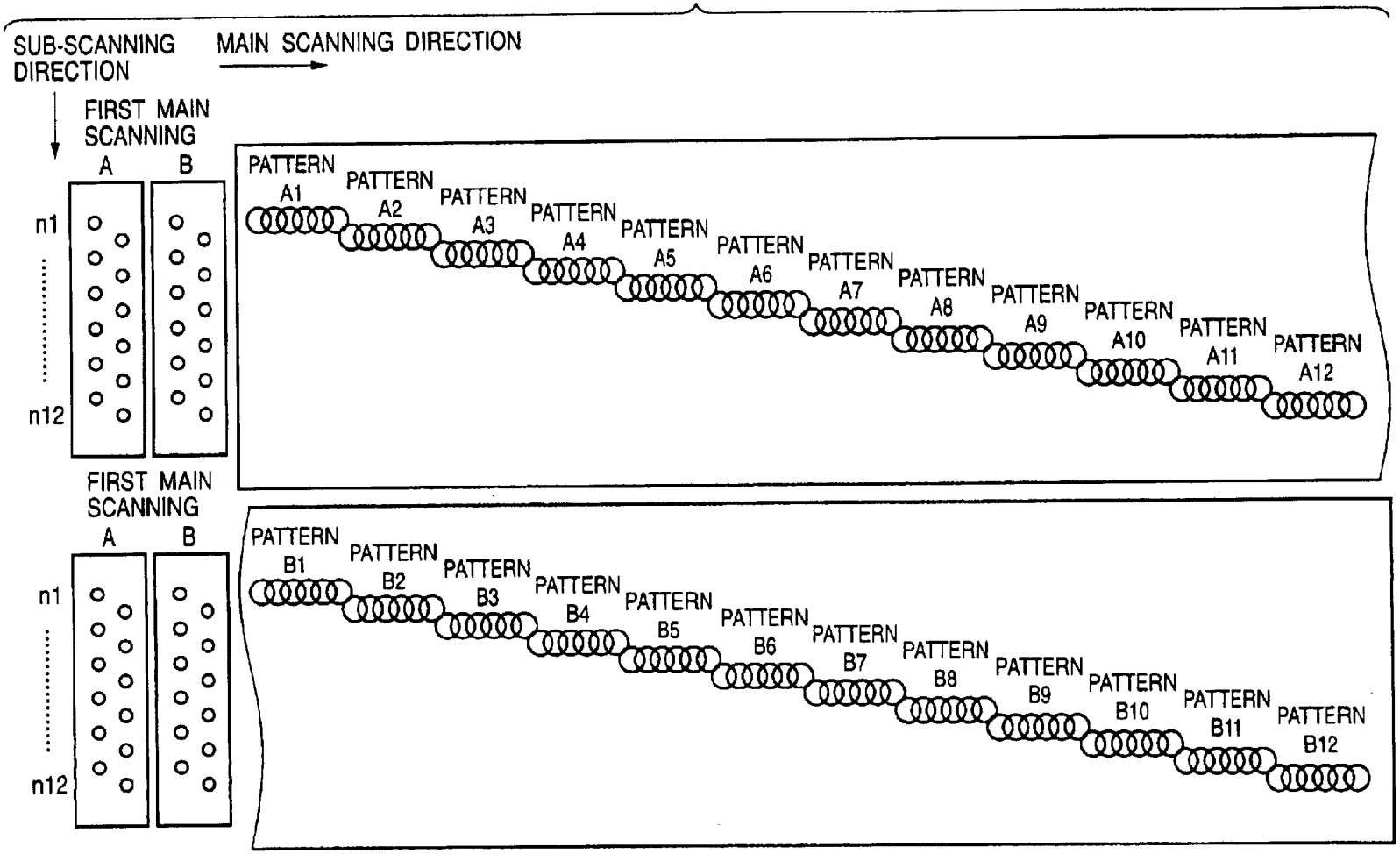
FIG. 16 PRIOR ART
FIG. 16 is a view for explaining a conventional visual verification test pattern.

As shown in FIG. 16, the two printheads are printhead A and printhead B. Each printhead has 12 checkered orifices n1 to n12.

Six ink droplets are discharged from the orifice n1 of printhead A in the main scanning direction at an interval of 600 dpi to print a straight line of pattern A1. Six ink droplets are discharged from the orifice n2 of printhead A in the main scanning direction at an interval of 600 dpi to print a straight line of pattern A2. Printing of a straight line by discharging six ink droplets from one orifice in the main scanning direction at an interval of 600 dpi is executed by the orifices n1 to n12 of printhead A in one main scanning. Printed patterns A1 to A12 are offset stepwise at 600 dpi in the sub-scanning direction.

After patterns A1 to A12 are printed by printhead A, a visual verification test pattern is printed by printhead B in the same main scanning. Similar to printhead A, six ink droplets are discharged from the orifice n1 of printhead B in the main scanning direction at an interval of 600 dpi to print a straight line of pattern B1. Six ink droplets are discharged from the orifice n2 of printhead B in the main scanning direction at an interval of 600 dpi to print a straight line of pattern B2. Printing of a straight line by discharging six ink droplets from one orifice in the main scanning direction at an interval of 600 dpi is executed by the orifices n1 to n12 of printhead B in the same main scanning as printhead A. Printed patterns B1 to B12 are offset stepwise at 600 dpi in the sub-scanning direction. Patterns B1 and A1, patterns B2 and A2, . . . , and patterns B12 and A12 are printed at the same sub-scanning positions.

Figure 17:
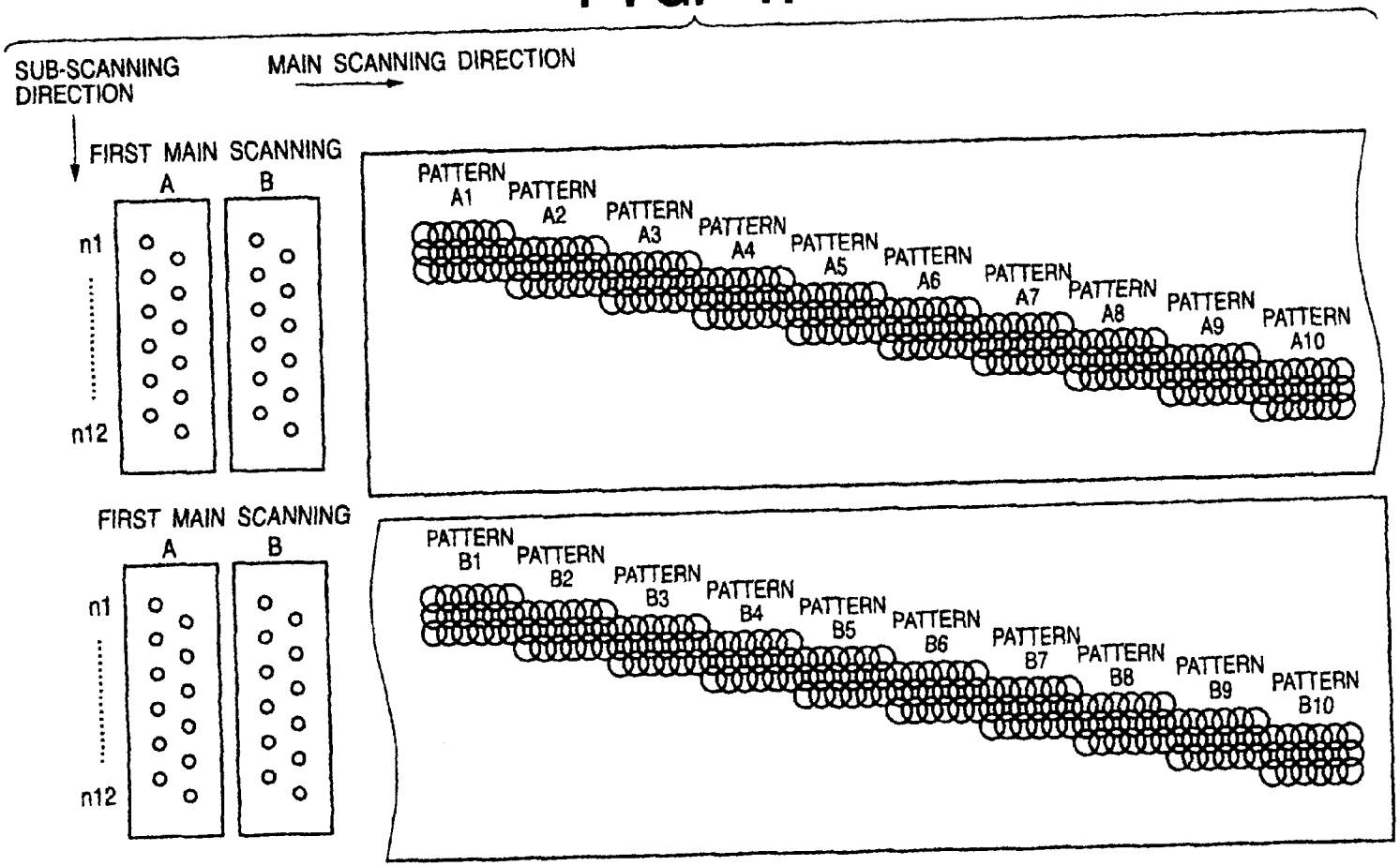
FIG. 17 is a view for explaining a visual verification test pattern according to the second embodiment of the present invention.

FIG. 17 is a view for explaining a visual verification test pattern for verifying the ink discharge state according to the second embodiment of the present invention. Two printheads used for printing are identical to those shown in FIG. 16.

Six ink droplets are discharged in parallel from each of the three orifices n1 to n3 of printhead A in the main scanning direction at an interval of 600 dpi to print a straight line of pattern A1. Six ink droplets are discharged in parallel from each of the three orifices n2 to n4 of printhead A in the main scanning direction at an interval of 600 dpi to print a straight line of pattern A2. Printing of a straight line by discharging six droplets in parallel from each of three orifices in the main scanning direction at an interval of 600 dpi is executed by the orifices n1 to n12 of printhead A in one main scanning. Printed patterns A1 to A10 are offset stepwise at 600 dpi in the sub-scanning direction.

After a visual verification test pattern is printed by printhead A, a visual verification test pattern is printed by printhead B in the same main scanning. Similar to printhead A, six ink droplets are discharged in parallel from each of the three orifices n1 to n3 of printhead B in the main scanning direction at an interval of 600 dpi to print a straight line of pattern B1. Six ink droplets are discharged in parallel from each of the three orifices n2 to n4 of printhead B in the main scanning direction at an interval of 600 dpi to print a straight line of pattern B2. Printing of a straight line by discharging six ink droplets from each of three orifices in the main scanning direction at an interval of 600 dpi is executed by the orifices n1 to n12 of printhead B in one main scanning. Printed patterns B1 to B10 are offset stepwise at 600 dpi in the sub-scanning direction. Patterns B1 and A1, patterns B2 and A2, . . . , and patterns B10 and A10 are printed at the same sub-scanning positions.

Figure 22:
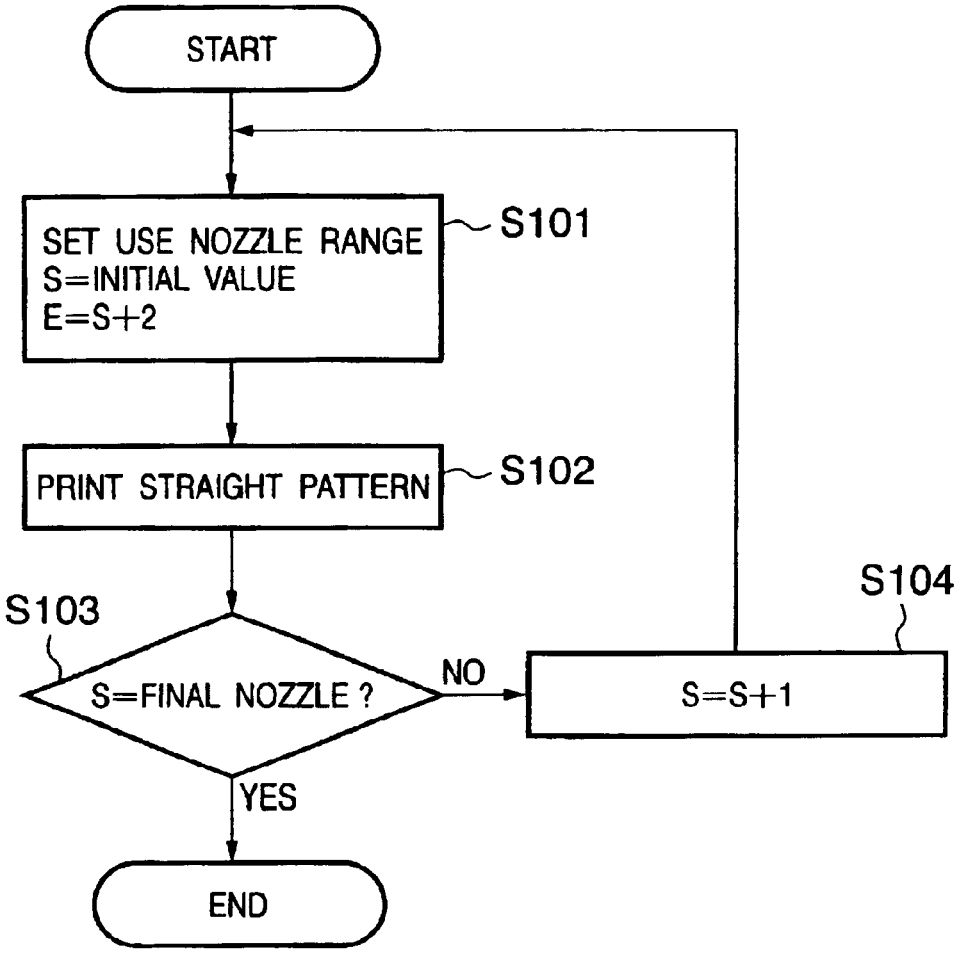
FIG. 22 is a flow chart showing a sequence of printing the visual verification test pattern in FIG. 11.

As a visual verification test pattern printing sequence according to the second embodiment, the sequence described in the first embodiment with reference to the flow chart of FIG. 22 is sequentially executed for two printheads.

As for the visual verification test pattern of the second embodiment, a visual verification test pattern printed when the discharge amount from one orifice is smaller than that of another orifice is the same as that shown in FIG. 12A in the first embodiment. More specifically, FIG. 12A illustrates patterns A2 to A4 and B2 to B4 of a conventional visual verification test pattern printed similarly to the patterns of FIG. 16 when discharge amounts from the orifices n3 of printheads A and B are as small as about 2.5 pl. FIG. 12B illustrates patterns A1 to A3 and B1 to B3 of a visual verification test pattern of the second embodiment printed similarly to the patterns of FIG. 17.

Similar to the first embodiment of the present invention, a pattern printed by the orifice n3 is determined as a thinner straight line than a straight line printed by another orifice in a conventional visual verification test pattern. In the visual verification test pattern of the second embodiment, no significant density difference is determined.

In the use of, e.g., the multipass printing method, visual verification consistent with an actually printed image can be done.

As described above, according to the second embodiment, variations which do not pose any problem in actual printing do not stand out, and an orifice which is verified as a discharge error upon actual printing can be determined. Variations between the printing characteristics of orifices can be verified at the same level as the use in actual printing. An increase in printhead cost due to over-quality by unnecessarily increasing the printhead precision can be prevented.

(Modification to Second Embodiment)

A visual verification test pattern is printed using two printheads in one main scanning in the second embodiment described above, but the present invention is not limited to this.

Figure 18:
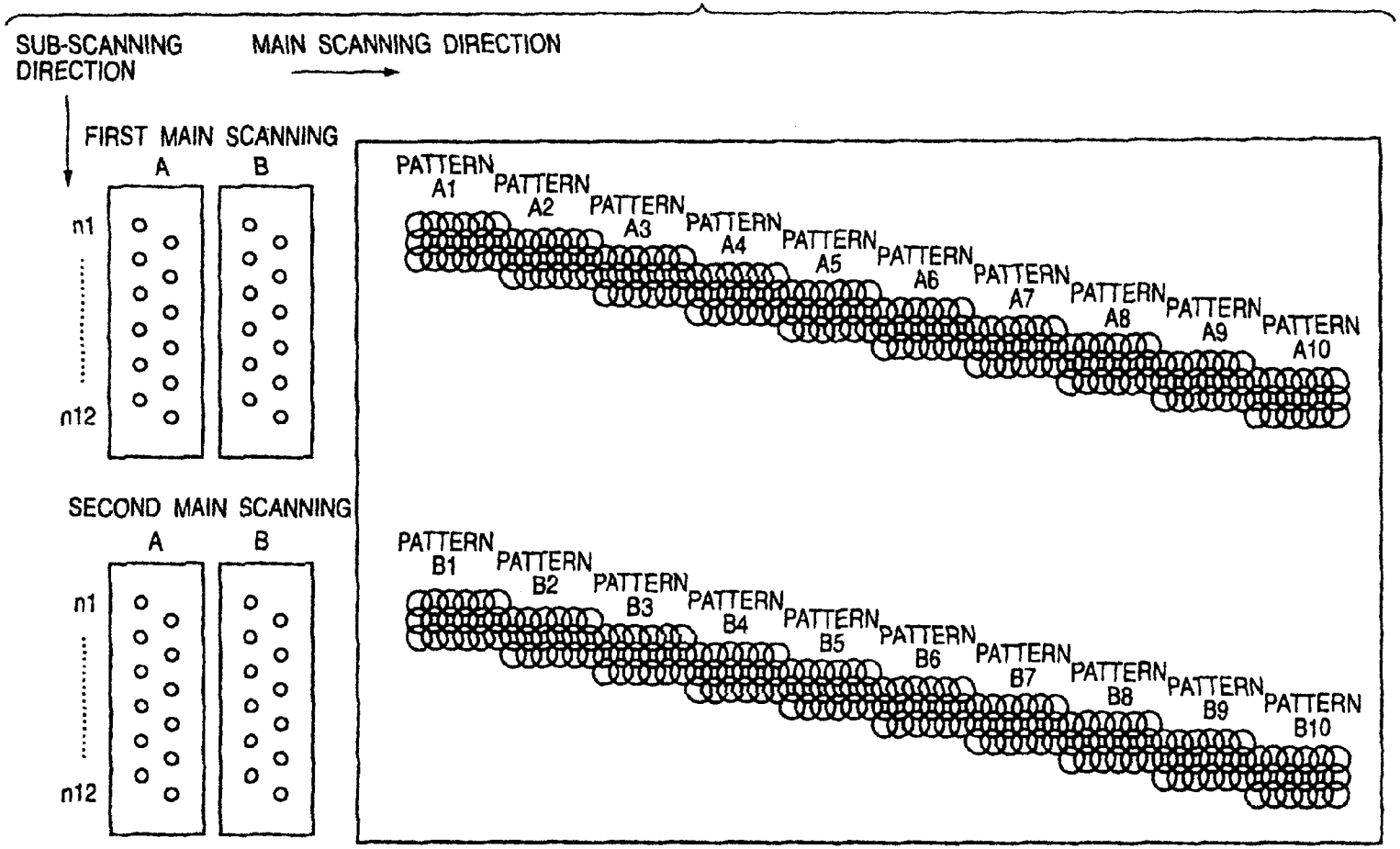
FIG. 18 is a view for explaining another visual verification test pattern according to the second embodiment of the present invention.

FIG. 18 is a view for explaining a visual verification test pattern printed by two main scanning operations using two printheads. The visual verification test pattern shown in FIG. 18 is obtained by printing a visual verification test pattern by printhead A in the first main scanning, then conveying the printing sheet in the sub-scanning direction, and printing a visual verification test pattern by printhead B in the second main scanning. This visual verification test pattern can also attain the same effects.

In the ink-jet printing apparatus of the second embodiment, two printheads are arranged side by side in the main scanning direction at the same sub-scanning position. The layout of the two printheads is not limited to this, and these printheads may be shifted in the sub-scanning direction.

The number of printheads used in the ink-jet printing apparatus is not limited to two, and three or more printheads may be used. The ink-jet printing apparatus may take an arrangement in which color printing is done by discharging inks in different colors from respective printheads.

Further, the intervals (offset distances) between patterns in the main scanning direction and sub-scanning direction in the visual verification test pattern are not limited to values in the embodiment, and proper values may be selected.

(Third Embodiment)

The third embodiment according to the present invention will be described. In the following description, a description of the same parts as those in the first and second embodiments will be omitted, and the feature of the third embodiment will be mainly explained.

Similar to the second embodiment, the third embodiment is related to a visual verification test pattern for an ink-jet printing apparatus which prints by using two printheads. The third embodiment concerns a visual verification test pattern when the discharge amounts of the two printheads are different.

In the ink-jet printing apparatus of the third embodiment, two printheads with a checkered layout shown in FIG. 9 are arranged side by side in the main scanning direction. These two printheads have different discharge amounts. The discharge amount of left printhead A in FIG. 19 is about 30 pl, and that of right printhead B is about 5 pl.

Figure 19:
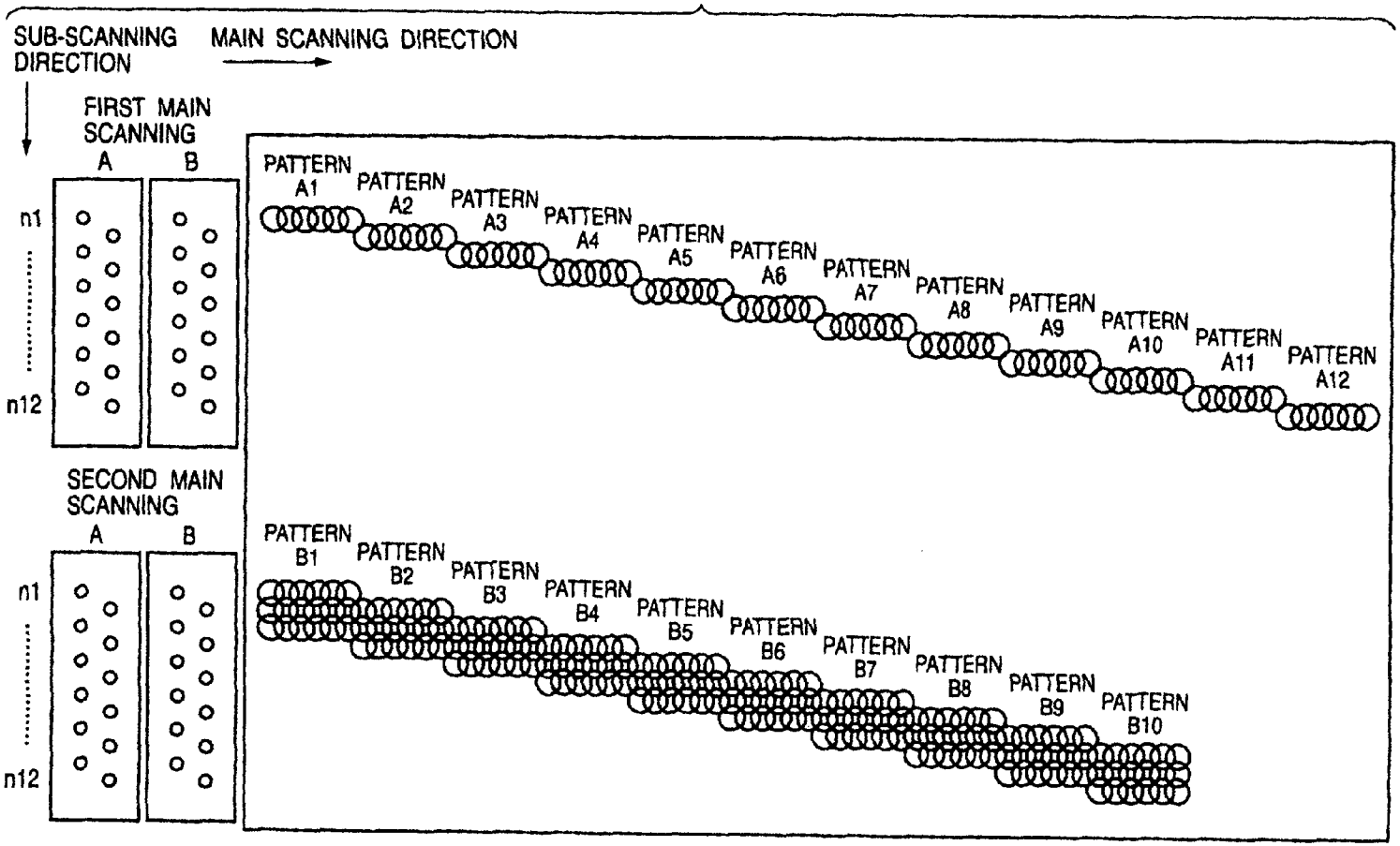
FIG. 19 is a view for explaining a visual verification test pattern according to the third embodiment of the present invention.

FIG. 19 is a view for explaining a visual verification test pattern for verifying the ink discharge state according to the third embodiment of the present invention.

In the first main scanning, a visual verification test pattern is printed by printhead A which discharges ink by a discharge amount of about 30 pl. Six ink droplets are discharged from the orifice n1 of printhead A in the main scanning direction at an interval of 600 dpi to print a straight line of pattern A1. Six ink droplets are discharged from the orifice n2 of printhead A in the main scanning direction at an interval of 600 dpi to print a straight line of pattern A2. Printing of a straight line by discharging six ink droplets from one orifice in the main scanning direction at an interval of 600 dpi is executed by the orifices n1 to n12 of printhead A in one main scanning. Printed patterns A1 to A12 are offset stepwise at 600 dpi in the sub-scanning direction.

After the printing sheet is conveyed in the sub-scanning direction, a visual verification test pattern is printed in the second main scanning by printhead B which discharges ink by a discharge amount of about 5 pl. Six ink droplets are discharged in parallel from each of the three orifices n1 to n3 of printhead B in the main scanning direction at an interval of 600 dpi to print a straight line of pattern B1. Six ink droplets are discharged in parallel from each of the three orifices n2 to n4 of printhead B in the main scanning direction at an interval of 600 dpi to print a straight line of pattern B2. Printing of a straight line by discharging six ink droplets in parallel from each of three orifices in the main scanning direction at an interval of 600 dpi is executed by the orifices n1 to n12 of printhead B in one main scanning. Printed patterns B1 to B10 are offset stepwise at 600 dpi in the sub-scanning direction.

As a visual verification test pattern printing sequence according to the third embodiment, the sequence described in the first embodiment with reference to the flow chart of FIG. 22 is sequentially executed for two printheads. For printhead A, the start orifice number (S) and end orifice number (E) are set to the same value, and a straight pattern is printed by one orifice.

The visual verification test pattern is changed between printheads having different discharge amounts because of the following reason. If the discharge amount is as large as about 30 pl, like printhead A, and the discharge amount from one orifice is as half as about 15 pl, the density of a straight line printed by this orifice is determined at low possibility to be thinner than another straight line. Even a visual verification test pattern similar to a conventional one can achieve its purpose. In this case, ink consumption does not increase in printing a visual verification test pattern by a printhead having a large discharge amount.

When the discharge amount is as small as about 5 pl, like printhead B, and the discharge amount from one orifice is as half as about 2.5 pl, the density difference from another straight line may be determined at high possibility in a conventional visual verification test pattern. To prevent this, a visual verification test pattern as shown in FIG. 19 according to the present invention is adopted to reduce the possibility of determining the density difference.

In the third embodiment, visual verification test patterns consistent with a printed image are printed by two printheads having different discharge amounts.

As described above, according to the third embodiment, an appropriate visual verification test pattern is printed in accordance with the discharge amount of the printhead or the like. Variations which do not pose any problem in actual printing do not stand out, and an orifice which is verified as a discharge error upon actual printing can be determined. Variations between the printing characteristics of orifices can be verified at the same level as the use in actual printing. An increase in printhead cost due to over-quality by unnecessarily increasing the printhead precision can be prevented.

(Modification to Third Embodiment)

In the third embodiment described above, visual verification test patterns are printed in different main scanning operations by two printheads having different discharge amounts. However, the present invention is not limited to this. For example, a visual verification test pattern may be first printed by printhead A, and then a visual verification test pattern may be printed by printhead B.

In the ink-jet printing apparatus of the third embodiment, two printheads having different discharge amounts are arranged side by side in the main scanning direction at the same sub-scanning position. The layout of the two printheads is not limited to this, and the printheads may be shifted in the sub-scanning direction.

In the third embodiment, the ink-jet printing apparatus uses two printheads having different discharge amounts. However, the present invention is not limited to this, and may use three or more printheads having different discharge amounts, or a combination of printheads, some of which have the same discharge amount. The color of ink used may be changed between printheads.

The intervals (offset distances) between patterns in the main scanning direction and sub-scanning direction in the visual verification test pattern are not limited to values in the embodiment, and proper values may be selected.

(Other Embodiment)

The present invention is applied to an ink-jet printing apparatus in the above-described embodiments, but may be applied to a printing apparatus of another printing type other than the ink-jet type.

More specifically, the present invention can be applied to a serial printing apparatus which prints by scanning a printhead having an array of printing elements on a printing medium in a direction crossing to a direction of the array.

The present invention can be most effectively applied to a printing apparatus which adopts the multipass printing method as a printing method. However, the above-described effects can also be obtained even when the present invention is applied to a printing apparatus which performs general 1-pass printing of printing each printing region by one main scanning.

As described in the third embodiment, the effects of the present invention are more prominent for a smaller dot (pixel or pixel building element) printed by a printing element.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796 is preferable. The above system is applicable to either one of so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note further that excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system comprising a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments being realized by executing the program codes which are read by a computer, the present invention also includes a case where an OS (operating system) or the like working on the computer performs parts or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part or entire process in accordance with designations of the program codes and realizes functions of the above embodiments.

If the present invention is realized as a storage medium, program codes corresponding to the above mentioned flowcharts (FIG. 22) are to be stored in the storage medium.

As is apparent, many different embodiments of the present invention can be made without departing from the spirit and scope thereof, so it is to be understood that the invention is not limited to the specific embodiments thereof except as defined in the appended claims.

What is claimed is:

1. A printing apparatus which prints by scanning a printhead having an array of printing elements adjacent a printing medium in a direction crossing to a direction of the array, said printing apparatus comprising:

test pattern printing means, when printing of a test pattern for verifying a printing characteristic of each printing element is designated, controlling driving of the printhead so as to print a test pattern including a plurality of straight patterns with a predetermined length in a scanning direction that are printed by driving adjacent printing elements in parallel, wherein all the printing elements are used for printing at least one straight pattern, wherein said test pattern printing means controls driving of the printhead so as to print the plurality of straight patterns by sequentially changing at least one of the adjacent printing elements used for printing from a printing element at one end of the printhead to a printing element at the other end of the printhead, and wherein said test pattern printing means controls driving of the printhead so as to shift the straight patterns from each other by a length not greater than the predetermined length in the scanning direction.

2. The apparatus according to claim 1, wherein the number of adjacent printing elements used for printing the straight pattern ranges from three to five.

3. The apparatus according to claim 1, wherein said test pattern printing means controls driving of the printhead so as to print the test pattern by one main scanning.

4. The apparatus according to claim 3, wherein said test pattern printing means controls driving of the printhead so as to print the plurality of straight patterns in parallel.

5. The apparatus according to claim 1, wherein said test pattern printing means controls driving of the printhead so as to print the test pattern by a plurality of main scanning.

6. The apparatus according to claim 1, wherein the printing apparatus comprises a plurality of printheads, and said test pattern printing means controls driving of the printheads so as to print the test pattern by each printhead.

7. The apparatus according to claim 1, wherein printing is performed by scanning each printing region a plurality of times.

8. The apparatus according to claim 1, wherein the printhead includes an ink-jet printhead which discharges ink to perform printing.

9. The apparatus according to claim 8, wherein the printhead includes a printhead which discharges ink by using heat energy, and comprises a thermal transducer for generating heat energy to be applied to ink.

10. A test pattern printing method of verifying a printing characteristic of each printing element in a printing apparatus which prints by scanning a printhead having an array of printing elements adjacent a printing medium in a direction crossing to a direction of the array, said method comprising the steps of:

a straight line printing step of driving adjacent printing elements in parallel to print a straight pattern with a predetermined length in a scanning direction; and a printing repeat step of executing the straight line printing step a plurality of times so as to use all the printing elements for printing at least one straight pattern, wherein in the printing repeat step, the straight line printing step is executed a plurality of times by sequentially changing at least one of the adjacent printing elements used for printing from a printing element at one end of the printhead to a printing element at the other end of the printhead, and wherein the straight patterns are shifted from each other by a length not greater than the predetermined length in the scanning direction.

11. The method according to claim 10, wherein the number of adjacent printing elements used for printing the straight pattern ranges from three to five.

12. The method according to claim 10, wherein in the printing repeat step, the straight line printing step is executed a plurality of times in one scanning.

13. The method according to claim 10, wherein in the printing repeat step, the straight line printing step is executed a plurality of times in a plurality of scanning.

14. The method according to claim 10, wherein the printing apparatus comprises a plurality of printheads, and the printing repeat step is executed for each printhead.

15. The method according to the claim 10, wherein the printing apparatus is so constituted as to print by scanning each printing region a plurality of times.

16. A test pattern printing method in a printing apparatus which prints an image by using a printhead having an array of printing elements for forming dots on a printing medium and relatively scanning the printhead adjacent the printing medium, wherein a step of printing a line in a direction different from a direction of the array that is obtained by printing with a predetermined length by a plurality of printing elements consecutive along the array including a predetermined printing element of the printhead and printing elements adjacent to the predetermined printing element while relatively scanning the printhead adjacent the printing medium is repeated while a next predetermined printing element is sequentially selected from the printing elements of the printhead, thereby performing printing, wherein the printing step is executed a plurality of times by sequentially changing at least one of the adjacent printing elements used for printing from a printing element at one end of the printhead to a printing element at the other end of the printhead, and wherein the lines are shifted from each other by a length not greater than the predetermined length in the scanning direction.

17. A computer program which causes a printing apparatus which prints by scanning a printhead having an array of printing elements adjacent a printing medium in a direction crossing to a direction of the array to print a test pattern for verifying a printing characteristic of each printing element, comprising program codes corresponding to:

a straight line printing step of driving adjacent printing elements in parallel to print a straight pattern with a predetermined length in a scanning direction, and a printing repeat step of executing the straight line printing step a plurality of times so as to use all the printing elements for printing at least one straight pattern, wherein in the printing repeat step, the straight line printing step is executed a plurality of times by sequentially changing at least one of the adjacent printing elements used for printing from a printing element at one end of the printhead to a printing element at the other end of the printhead, and wherein the straight patterns are shifted from each other by a length not greater than the predetermined length in the scanning direction.

* * * * *